US010058122B2

(12) United States Patent
Steingraber et al.

(10) Patent No.: US 10,058,122 B2
(45) Date of Patent: Aug. 28, 2018

(54) ELECTRONIC CIGARETTE

(71) Applicants: Matthew Steingraber, Tarpon Springs, FL (US); Danielle Steingraber, Tarpon Springs, FL (US); Michael Murray, Tarpon Springs, FL (US)

(72) Inventors: Matthew Steingraber, Tarpon Springs, FL (US); Danielle Steingraber, Tarpon Springs, FL (US); Michael Murray, Tarpon Springs, FL (US)

( * ) Notice: Subject to any disclaimer, the term of this patent is extended or adjusted under 35 U.S.C. 154(b) by 1064 days.

(21) Appl. No.: 14/063,066

(22) Filed: Jun. 11, 2014

(65) Prior Publication Data

US 2015/0053217 A1 Feb. 26, 2015

Related U.S. Application Data

(60) Provisional application No. 61/718,336, filed on Oct. 25, 2012, provisional application No. 61/735,157, filed on Dec. 10, 2012, provisional application No. 61/735,164, filed on Dec. 10, 2012.

(51) Int. Cl.
*A24F 47/00* (2006.01)

(52) U.S. Cl.
CPC ..... *A24F 47/008* (2013.01)

(58) Field of Classification Search
CPC ..... A24F 47/008; A24F 47/002; A24F 47/00
USPC ..... 131/329, 347
See application file for complete search history.

(56) References Cited

U.S. PATENT DOCUMENTS

| | | | | | |
|---|---|---|---|---|---|
| 6,125,082 | A * | 9/2000 | Reid | A24F 15/005 | 131/270 |
| 2007/0267031 | A1* | 11/2007 | Hon | A24F 47/008 | 131/273 |
| 2010/0031968 | A1* | 2/2010 | Sheikh | A24F 47/008 | 131/347 |
| 2011/0277760 | A1* | 11/2011 | Terry | A24F 47/008 | 128/203.12 |
| 2012/0199146 | A1* | 8/2012 | Marangos | A24F 47/008 | 131/328 |
| 2013/0056013 | A1* | 3/2013 | Terry | A24F 47/008 | 131/328 |
| 2013/0081642 | A1* | 4/2013 | Safari | A24F 47/008 | 131/329 |
| 2015/0053217 | A1* | 2/2015 | Steingraber | A24F 47/008 | 131/329 |
| 2015/0245660 | A1* | 9/2015 | Lord | H04W 8/24 | 131/328 |
| 2016/0050975 | A1* | 2/2016 | Worm | A24F 47/008 | 131/328 |

* cited by examiner

*Primary Examiner* — Abdullah Riyami
*Assistant Examiner* — Nader Alhawamdeh
(74) *Attorney, Agent, or Firm* — David W. Barman

(57) ABSTRACT

An electronic cigarette with inlet air constructed and arranged to contact a delivery substance and minimize airflow over electronic components.

15 Claims, 24 Drawing Sheets

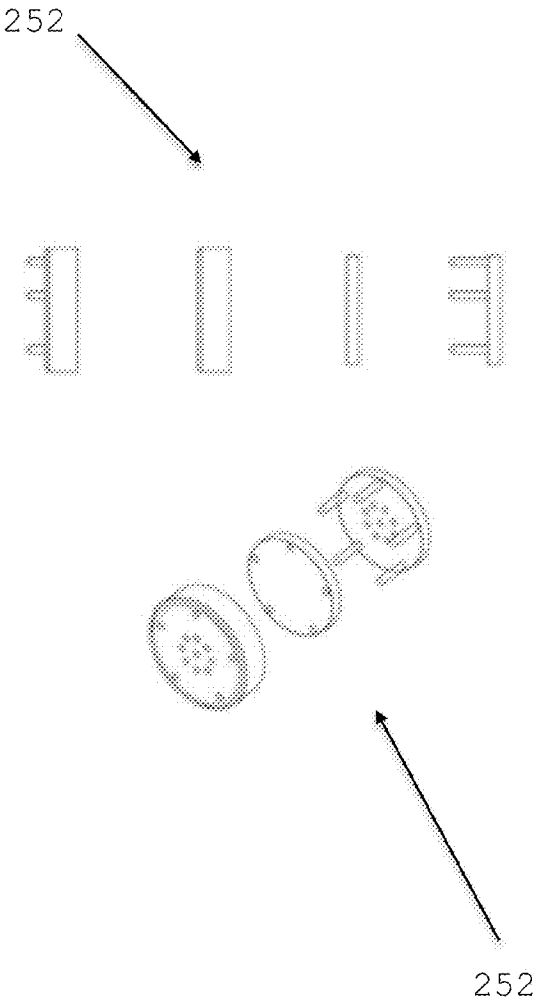
Fig. 14
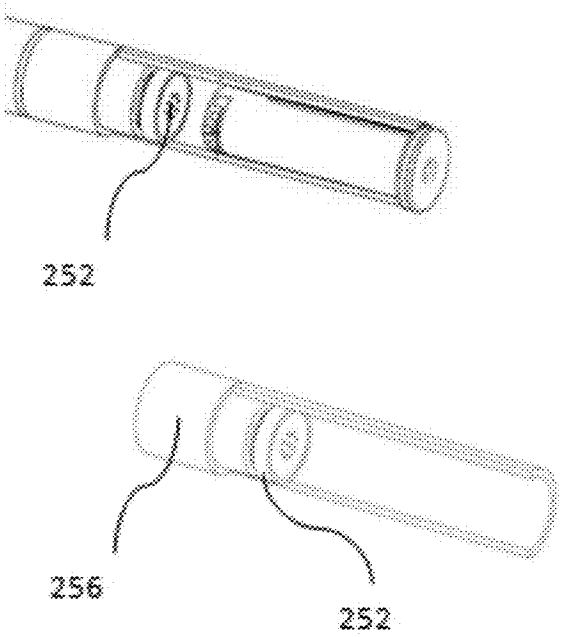

ELECTRONIC CIGARETTE

INDEX TO RELATED APPLICATIONS

This application is a non-provisional of and claims benefit to each of U.S. Provisional Patent Application Ser. No. 61/718,336, filed Oct. 25, 2012; U.S. Provisional Patent Application Ser. No. 61/735,157, filed Dec. 10, 2012; and of U.S. Provisional Patent Application Ser. No. 61/735,164, filed Dec. 10, 2012, the disclosures of which are each incorporated herein by reference in their entirety.

BACKGROUND OF THE INVENTION

Electronic cigarettes are gaining popularity for a variety of reasons. However, with increased popularity, e-cigarette configuration flaws have raised several issues.

One main issue with the assembly process is due to the hand assembly process. This creates a human error factor in the assembly process. Due to the human error factor, the products currently on the market are of inferior quality and possess unacceptable levels of variability.

Below is a list of several of the issues known and identified in the design of electronic cigarettes presently on the market:

1. The Nichrome wire wound around the wick is assembled by hand, at various tensions and using various numbers of windings. Sometimes there will be four windings around the wick, and sometimes there may be six.
2. The current e-cigarette cartridge assembly has a potential to leak nicotine liquid. This condition will reduce shelf life and convey inferior quality to the consumer.
3. The batteries elicit unacceptable power output variability.
4. The saturated wadding which transfers e-liquid via capillary action to the wick varies in volume.
5. With the vacuum switch located at the ash tip end of most E cigarettes, the user draws air at the mouthpiece through the vacuum switch, across the battery and all of the electronic components, and into the lungs. Thus picking up any vapors that may be present as these components outgas over time.
6. The anode collars on the battery assembly and the heater cartridge assembly are a press fit configuration. The internal wires of the heater cartridge assembly and the internal wires of the battery assembly often exhibit a lack of proper insulation. Should a consumer thread a battery onto a heater cartridge assembly over tightening may occur, resulting in a broken seal between the anode collar and the outer steel casing. When this occurs, continuous over tightening will twist the internal wires of the battery cartridge assembly causing a failure to all components.
7. The electrical contacts in the anode collar assemblies are supported by a silicone insulating tube, which creates a spring action. When a consumer threads the heater cartridge assembly onto the battery assembly, the silicone tube may over compress causing a failure.
8. The heater cartridge assemblies are filled with E liquid by hand, this method can result in an unacceptable level of variability, with respect to the useful life of the product.
9. By its nature and design the current cartridge requires hand assembly, which results in the variability of vapor output.

10. The vacuum switches, poor location, and lack of proper sealing can inadvertently activate the heating coil.
11. Many of the internal electronics have small wires that are hand-soldered to components, resulting in an unacceptable level of variability
12. The current battery design requires two or more hours to recharge.
13. Because this battery lacks a state of charge indicator, it is impossible for a user to accurately predict useful life remaining.
14. When one replaces the heater cartridge assembly a user is throwing away the complete heater assembly. In one embodiment of the new configuration the e-liquid is segregated from the heater assembly to reduce the amount of scrap and waste material.

These are just to name the basic or most common problems identified with the current products.

SUMMARY OF THE INVENTION

Brief Description of the Several Views of the Drawings

FIG. 14 shows components incorporated into the tip.

DETAILED DESCRIPTION OF THE PREFERRED EMBODIMENT

Figure 1:
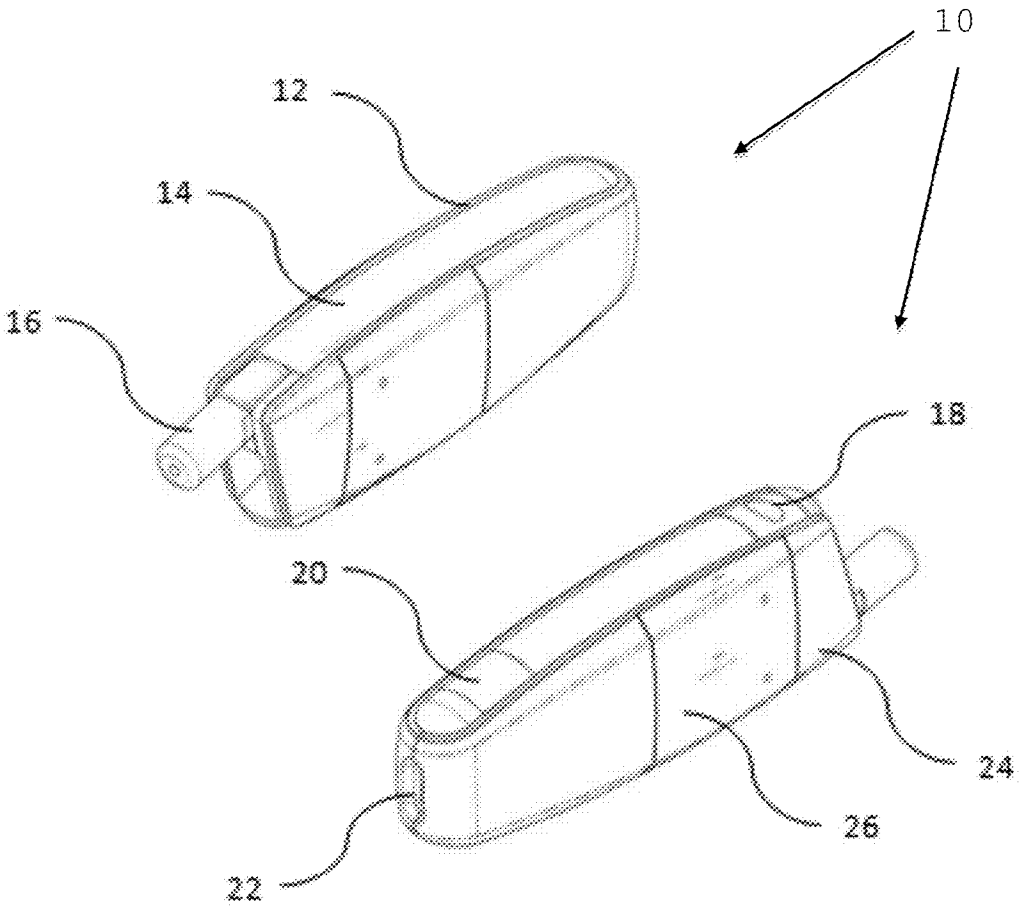
FIG. 1 are perspective side views of one embodiment of the present invention.

The present invention overcomes the problems referenced in the background of invention section by providing a device 10 having a metal frame, 14, and two external plastic panels, a first external plastic panel 12 and a second external plastic panel 24, a removable side cover 26 that is configured to provides an air inlet, a mouthpiece 16, a vapor/pressure/atomizer cavity 40 (which houses two cartridges and vacuum switch), an electronics cavity 39 sealed from the vapor cavity (which houses the main PCBA 36, that includes the microprocessor with PWM circuitry, battery 38, speaker, microphone, secondary PCBA with LED's for battery—the figures do not specifically show the speaker, microphone, secondary PCBA with LED's for battery because they are configured and integral with main PCBA 36), a button mechanism 18 to flip out the mouthpiece. Device 10 has an opening 22 for accessing micro USB 37.

Some of the advantages of the present invention are that it allows for users to mix flavors of nicotine, have increased time between battery recharges, and liquid cartridge changes. Ability to interact with their device either through a GUI/computer or their own voice, and control and change the characteristics of how the device operates. Use of Authentication on the cartridges allows for encryption so that cartridges cannot be duplicated or reused. In one embodiment, the battery component is completely segregated from the vapor stream that is inhaled by the user.

Figure 2:
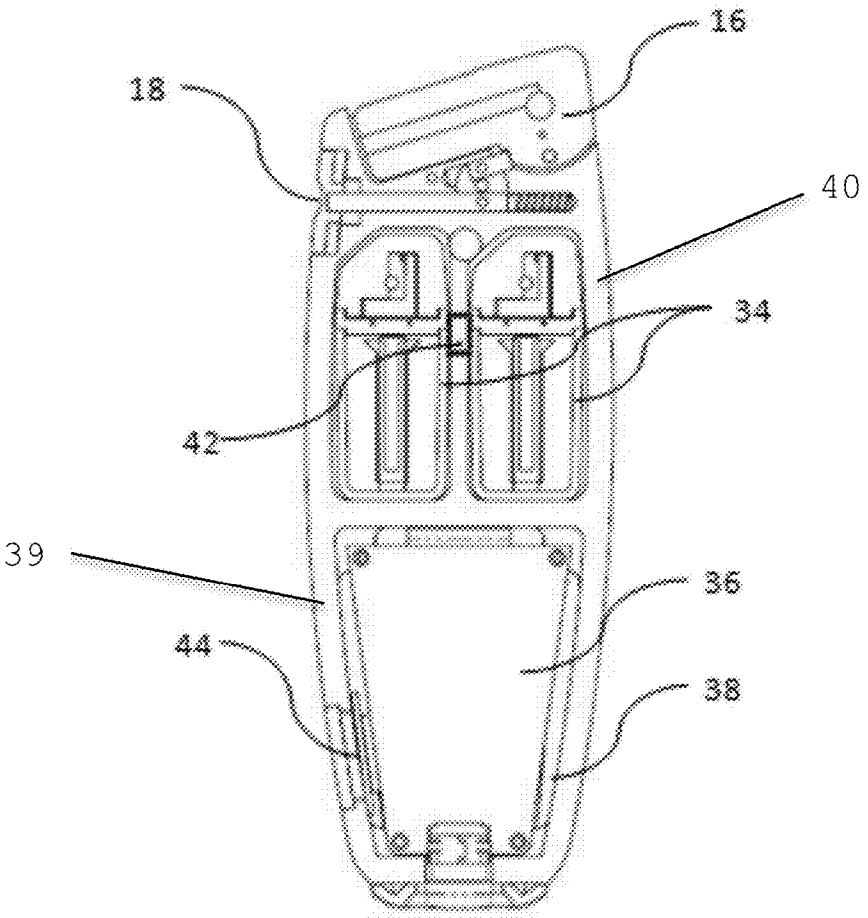
FIG. 2 is plan view of the inner components of one embodiment of the present invention.
Figure 3:
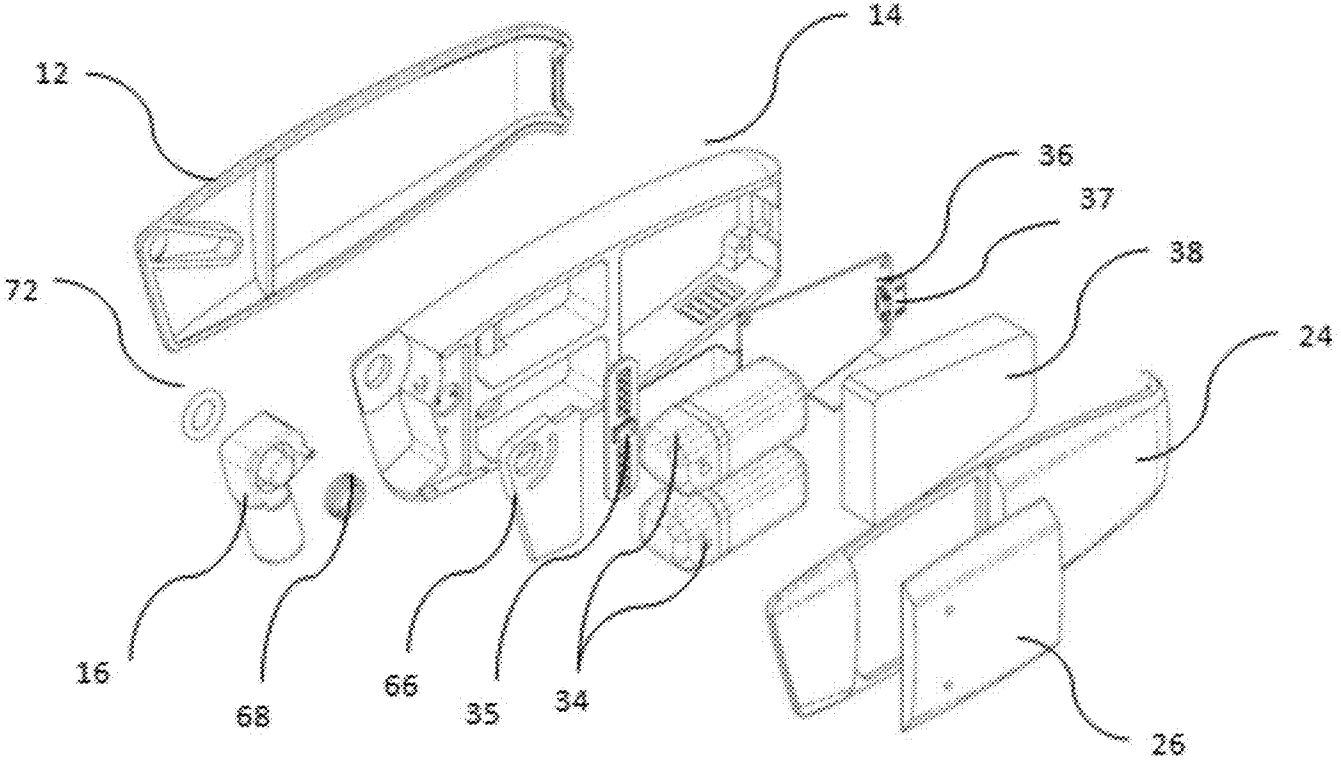
FIG. 3 perspective separated view of the inner components of one embodiment of the present invention.
Figure 4:
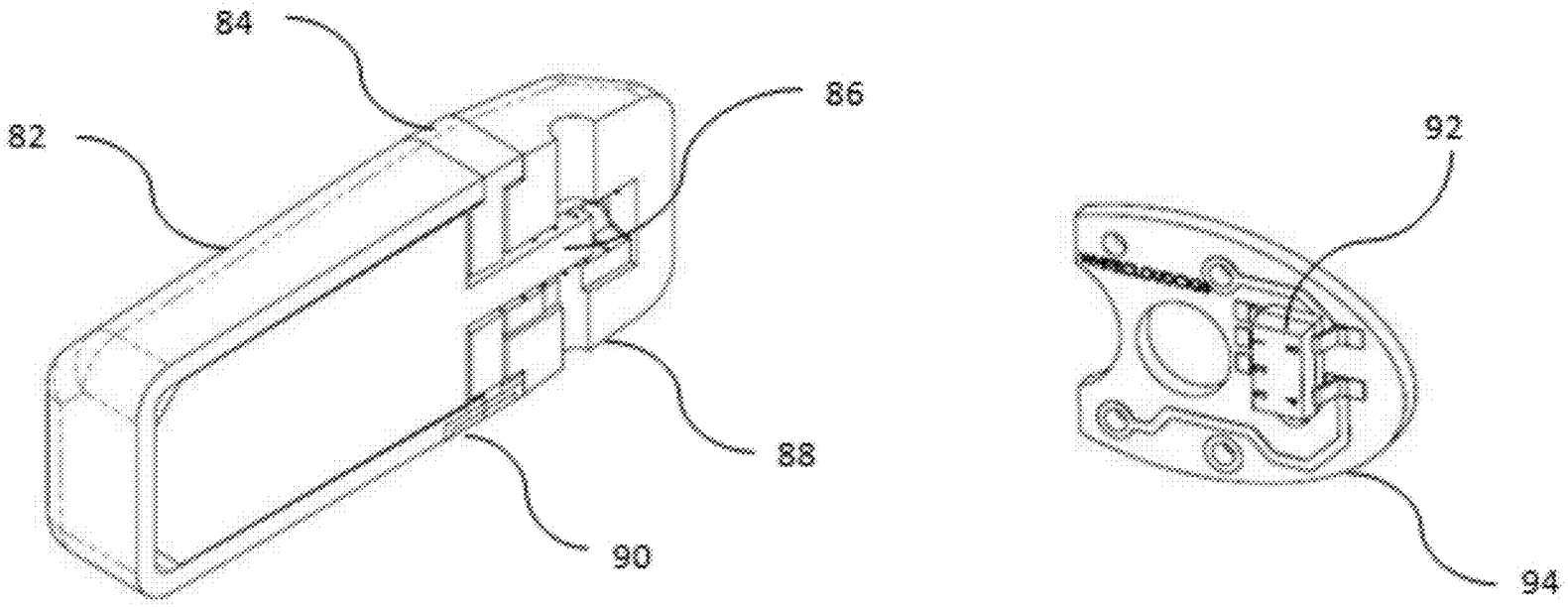
FIG. 4 is a view of an open unit showing interior components.

Mouthpiece:

As shown in FIG. 1-3, the present invention, in one embodiment has a rotatable mouth tip 16, made of soft rubber material contained in the metal housing 14 by seal 72. Tip 16 is released by pressing the button 18 which is held into place by panel 66. When a user is done they can store the tip back inside the unit by rotating the mouthpiece back into the device.

When users want to change or insert liquid cartridges 34, they will remove the side door 26. Users will then pull the old liquid cartridges 34 to remove them. Once removed users will insert new cartridges 34 in the correct orientation. The cartridges include a cartridge body, 82, plug, 84, heating element 86, and cap, 88.

The proposed PCB, 36, for the new unit will be a rigid PCB in the bottom of the assembly. The vacuum switch PCBA, 35, turns the unit on when a user inhales. The PCB houses a Micro USB, 37, a vacuum switch, 35, a battery, 38, indication LED's, 20, and a microprocessor. In one embodiment, there are two separate cartomizers, 34, each with their own heater controlled by a PWM microprocessor on the PCBA board, 36, allowing for variable heater intensity and combining of flavors. The connections to the heater and EEPROM go through a custom anode, 94. The battery, 38, connects to the board using a Molex wire-to-board assembly.

Another embodiment of the present invention will allow the user to identify the remaining fluid in their cartridge without having to remove the cartridge or do a visual check. By utilizing a microphone embedded into the center of the vacuum switch PCBA, 35, the unit will be able to sense when there is a puff occurring by listening for the sound of inhalation. When a user puffs on the device, air is drawn into the unit. This air creates a sound based on the configuration of the holes. The microphone is tuned to the frequency of this sound and activates based on it. The microphone will not activate based on any other sound, thereby removing the possibility of a false activation. This alone will be used for heater activation; by obtaining the duration of the puff, users should be able to accurately predict the amount of liquid used in that puff.

Upon inserting a new liquid cartridge into the device and taking the first puff the microphone passes this information to the microcontroller. The microcontroller calculates the amount of fluid used and passes that information to the EEPROM, 92. Once users reach 110% capacity, this allows for 10% in calculations, of the cartomizer the unit no longer will activate the heater until a new liquid cartridge is inserted. As the user depletes the liquid in the cartridge they are notified of the remaining liquid level via the optional microphone on PCBA, 36. This feature allows the user to easily identify when a new liquid cartridge is needed.

Microphone from a technical aspect: Analog Devices—ADMP404 The ADMP404 is a high quality, high performance, low power, and analog output bottom-ported omnidirectional MEMS microphone. The unit includes a MEMS microphone element, an impedance converter, and an output amplifier. The sensitivity specifications make it an excellent choice for near field applications. The unit has a high SNR and flat, wideband frequency response, plus its low current consumption enables long battery life for portable applications. The ADMP404 is halide free.

As used herein, "authentication" refers to the process by which the system is limited to an operating state only when an authenticated cartridge is secured therein. Authentication includes, but is not limited to NVRAM, EPROM, EEPROM, EEPROM with a Serial No., Authentication chip, combinations thereof, and the like.

In one embodiment, the cartridge is constructed and arranged in a manner such that the authentication is disabled and/or destroyed if a user tries to refill the cartridge. In this embodiment, this prevents unauthorized materials being used with the electronic cigarette of the present invention.

NVRAM:

To prevent a third party from creating a replacement cartridge, one preferred embodiment requires the cartridge must have a way to guarantee uniqueness. Having unauthorized cartridges can lead to device failure and revenue loss.

To meet this configuration requirement the Atmel ATSHA204 authentication chip was selected. This chip would provide all of the necessary features to implement the currently understood requirements.

The Atmel ATSHA204 provides:

SHA-256 hash algorithm
4.5-Kbit EEPROM
Robust hardware authentication
Secure key/data storage
Straightforward, 256-bit challenge/response protocol.
High-quality hardware random number generator
Guaranteed unique serial number
512 bits of OTP (One Time Programmable) memory.
Monotonic Usage Counter to prevent refill/refurbishment
Other potential options are listed below.

Option 1: EEPROM (Electronically Erasable Programmable Read Only Memory)

A simple EEPROM, 92, will allow the memory to be cleared and overwritten. By allowing the memory to be erased and re-written the user may reset their counters and change the number of uses. Additionally by allowing the memory to be erased and re-written the cartridges may also be refurbished by either the end customer or a third party.

- If an EEPROM is used in the cartridge the user can change the remaining uses, which will bypass the end of life for the cartridge. By doing this, the user makes it possible for the cartridge to be totally used and for the wick to dry out potentially causing an overheating situation and/or the user to inhale contaminants from the wick. Additionally when the cartridge is expired it is rather trivial for an electronics competent user to reset the counter and refill their cartridge.
- The EEPROM will virtually provide no protection from cloning and this opens up the possibility of catastrophic failure of the unit.
- A simple EEPROM will require an I2C interface, which requires two signal pins (Clock and Data) whereas the Atmel ATSHA204 would use the Atmel 1 wire interface with required only 1 data line. This makes the cartridge have one less mechanical interface contact to the main board. Additionally using an I2C EEPROM will require an additional I2C switch on the main board which will add to its BOM cost ~40 cents in additional to the mechanical pins and require the use of a larger processor package for the CPU.
- A simple EEPROM chip may be less expensive on paper and in the short term, but this does not include costs associated with the need for another printed circuit board in/on the cartridge.

Option 2: EPROM (Electronically Programmable Read Only Memory)

- As with the authentication one weakness of the EPROM option is a third party may make a copy of the cartridge, replacing the EPROM with a programmable device, which emulates the EPROM and contains the counter. This would allow the user (or factory) to reset the counter and hence refill the cartridge. This is MUCH more involved and not a simple or trivial task but it can be done.
- Using an EPROM with a unique serial number would require a cloner to either replace the EPROM with a programmable device or crack the authentication algorithm. The easiest way to get around this would be for the cloner to try to hack into the device processor firmware to try to discover the algorithm.
- If the algorithm is discovered a cloner can produce cartridges at will.
- A summary of the options is present below in Table 1:

Device Memory Comparison Matrix

| | Option 1 | | | Option 3 Authentication IC Atmel ATSHA204 (1 Wire) |
|---|---|---|---|---|
| | EEPROM | EEPROM W/Serial no. | Option 2 EPROM | |
| Cartridge Authentication | No (only Identification) | Yes | Yes - (if it has a serial #) | Yes |

-continued

Device Memory Comparison Matrix

| | Option 1 | | | Option 3 Authentication IC Atmel ATSHA204 (1 Wire) |
|---|---|---|---|---|
| | EEPROM | EEPROM W/Serial no. | Option 2 EPROM | |
| Maintain cartridge Usage data (how many puffs remaining) | Yes (easily changeable) | Yes (easily changeable) | Yes | Yes |
| Ability to expire cartridge | Yes | Yes | Yes | Yes |
| Prevent end user refills | No | Yes | Yes | Yes |
| Anti-cloning Protection | No | Yes - Possible | Yes - Possible | Yes |

Figure 16:
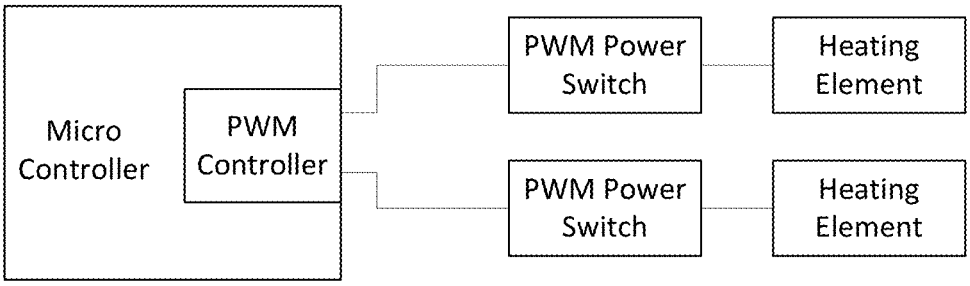
FIG. 16 is a general block diagram of the PCBA.

Microprocessor:

A general block diagram of the PCBA, 10, heating control configuration is shown in FIG. 16.

Figure 17:
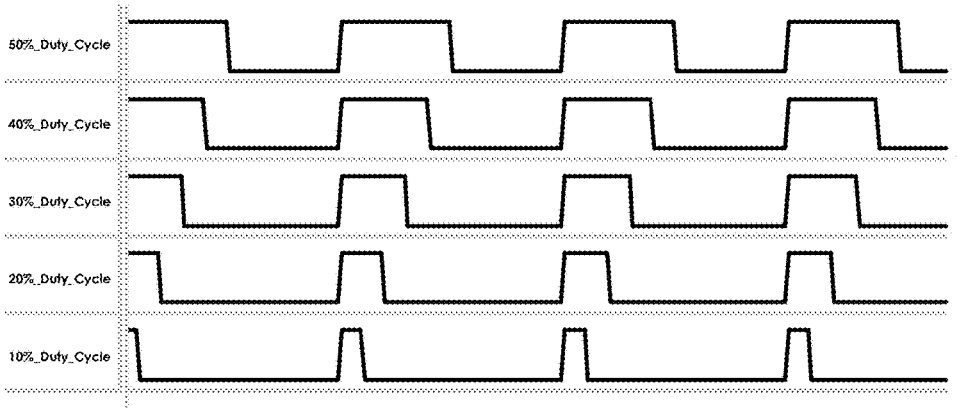
FIG. 17 is a table showing the voltage from the PWM Controller is high the PWM switches pass power from the system battery to the heating elements.

The microcontroller has an embedded PWM (Pulse Width Modulation) waveform generator, which creates repeating pulses of voltage with varying pulse widths. These voltage pulses are used as control inputs to power switches, which provide power to the cartridge heating elements. While the voltage from the PWM Controller is high the PWM switches pass power from the system battery to the heating elements an is shown in FIG. 17.

Figure 18:
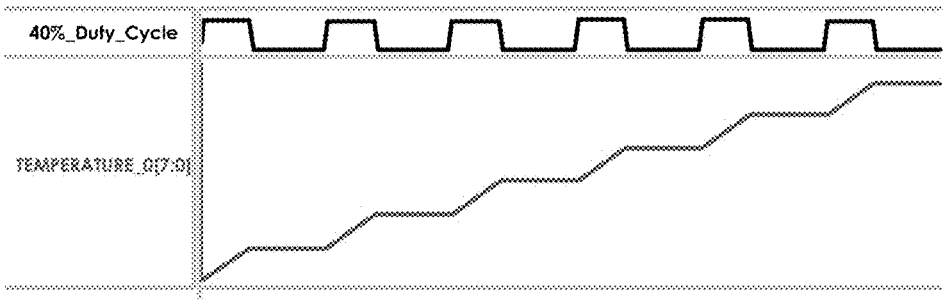
FIG. 18 is a chart showing when power flows to the heating element the temperature rises on the elements.

When power flows to the heating element the temperature rises on the elements as shown in FIG. 18.

Figure 19:
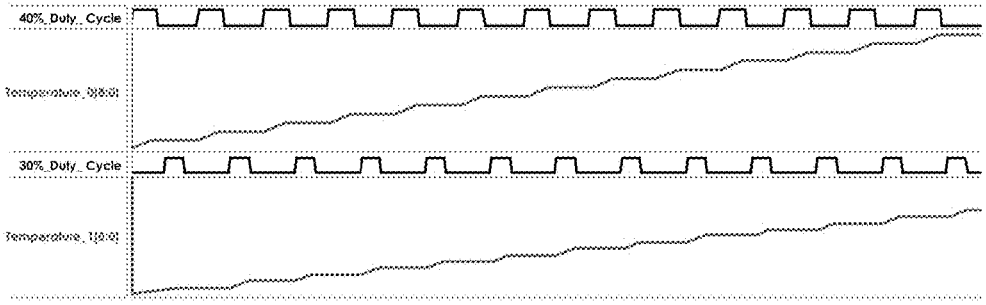
FIG. 19 is a chart showing the simulated temperature "TEMPERATURE_0[8:0]" which was generated from the 40% duty cycle goes up faster than the simulated temperature "TEMPERATURE_1[8:0]" which was generated by a 30% duty cycle wave

When the control voltage is low the temperature will decrease however the decrease will be at a slower rate than the temperature rise which yields a significant net gain in temperature. Note in the picture below the simulated temperature "TEMPERATURE_0[8:0]" which was generated from the 40% duty cycle goes up faster than the simulated temperature "TEMPERATURE_1[8:0]" which was generated by a 30% duty cycle wave as shown in FIG. 19.

The temperature will stabilize based upon the average power applied to the coil and the combination of the thermal dissipation of all of the elements which are making contact with the heating element. The most significant heat dissipation mechanism is the evaporating glycol liquid. As the glycol evaporates the heat goes into the glycol rather than heating the heating element further. By changing the duty cycle the average power delivered to the coil is controlled which in turn directly affects the amount of glycol being vaporized at any given time.

By adjusting the average power to the coil the present invention will control the mixture of the two e-cig cartridges to allow the user to customize the mixture on the fly.

To reduce the instantaneous current from the battery the PWMs are driven out of phase to the effect that both PWM Power Switches are not conducting at the same times shown below in Table 6.

The PWM switches draws power straight from the system battery. Due to the fact that the battery voltage will drop as it is loaded down the software will need to adjust the PWM Duty Cycle to maintain a constant average power over the entire battery discharge life. The user will specify a percentage from 0% to 100% for a mixture ratio of each cartridge and the software will adjust the PWM Duty Cycle on the fly by monitoring the voltage from the battery. Additionally software will adjust the PWM of both cartridges to provide maximum power upon start up to get the starting temperature up to the estimated power point quick as possible. The software will then back the power down to keep the power in the required power envelope.

To protect the device from a runaway heater, the microcontroller software will limit the e-cig drag time to a predetermined amount of time followed by a predetermined cooling off period. Additionally the microcontroller will have a detection mechanism to detect that there is a cartridge present, and that the cartridge is genuine, before power is applied to the heating element.

In one embodiment, The present invention utilizes a prismatic 3.7v 1,300 mAh LiPo rechargeable battery, 38, placed in the bottom of the unit with the PCBA, 10, and connected via a 28 AWG wire-to-board Molex connector for ease in assembly. LiPo presents a safer alternative to Li-ion batteries in that they do not create as much heat or swelling during discharge. In addition a LiPo will not typically explode during a catastrophic failure of the casing. The prismatic shape is necessary to maximize the capacity of the battery relative to the space allowed. By increasing the battery capacity to 950 mAh the user will enjoy a large increase in time between charging even with two cartridges.

This configuration will allow a max of 4 W of average power. The following numbers assume the following:

Assuming 2 cartridges at 100% mixture each

A Nominal battery voltage of 3.7V

Battery density of 750 mAh de-rated for 80% battery life and max 80% battery drain allowance Battery Density=750 mAh*80%*80%=480 mAh Average Battery Voltage=3.7V Battery Power Density=3.7V*480 mAh=1.776 Wh Maximum Power Per Cartridge=4 W Vape Time w/2× Cartridged at Max=1.776 Wh/(4 W*2)=0.222 h=13.32 min=799.2 sec Average puff duration 2 seconds Number of puffs per battery charge=(799.2 sec)/(2 sec/puff)=399.6 puffs Speaker:

In another embodiment of the present invention has a small piezoelectric speaker, similar to those used in inner-ear hearing aids was to be placed on the PCBA, 36. The speaker would provide status tones for fluid and battery level as well as simulate the crackling sound of a traditional cigarette.

Micro-USB Type B:

In one embodiment, the present invention incorporates a micro-USB type B female receptacle, 37, that are placed on the PCB, 36. This USB is used in conjunction with a male micro USB type B cable for connection to a standard computer USB port as well as a separate inverter for use in a standard home electrical outlet. The micro-USB serves to charge the device as well as interact with the GUI (see GUI) to control features of the device. The device will utilize both the data and the 5V electrical lines in the USB. All charging circuitry is located on the PCB internally. Additionally this will allow connection to a mobile device such as tablets or smartphones. This configuration allows the user to continue using the electronic cigarette while charging and does not require disassembly of the product.

Figure 5:
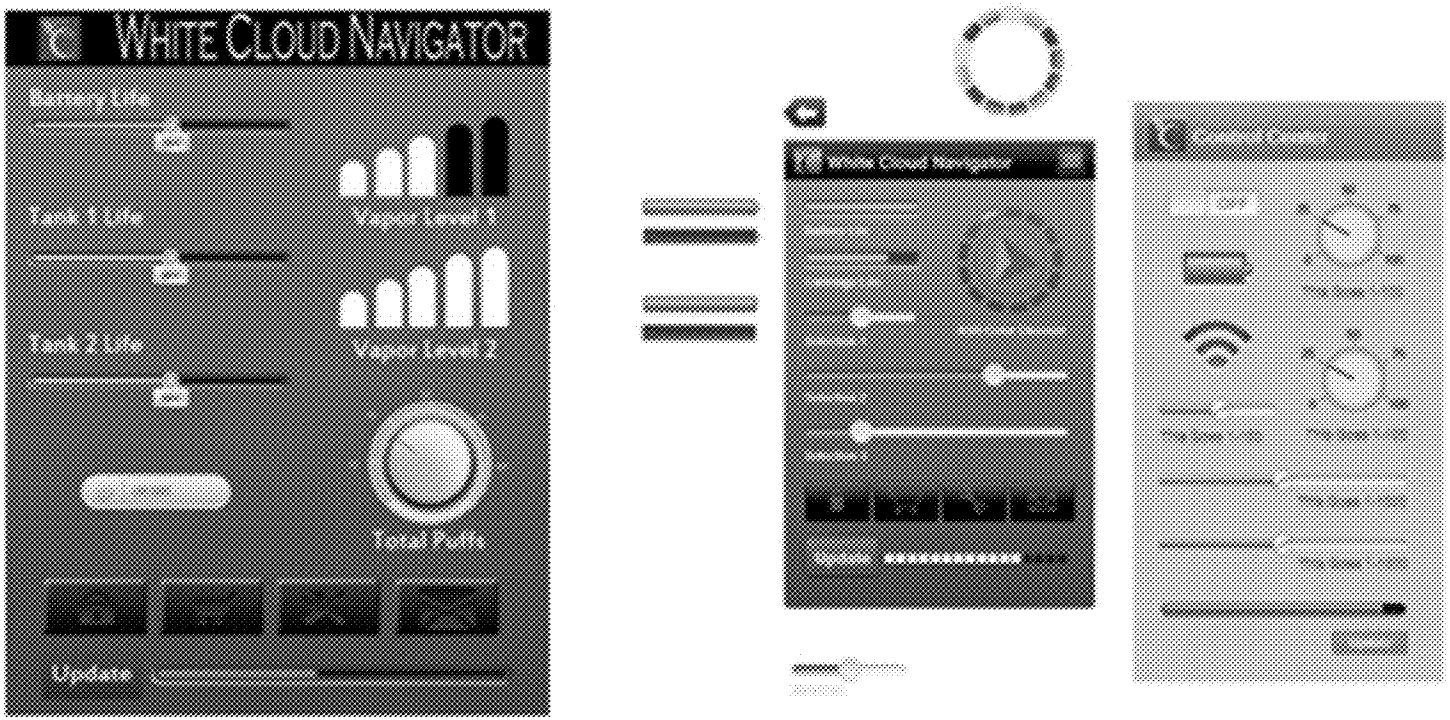
FIG. 5 demonstrates a graphic user interface of the present invention.

GUI (Graphical User Interface):

As shown in FIG. 5, in this embodiment, a GUI has been developed to allow the user to control certain features and monitor certain states of their product. The GUI will initially be available for access on both MAC and PC, with the GUI being stored internally to the device. A further option available to the consumer, once connected to a computer, will be activation via the Internet allowing for additional features and registration of the device. The main features included are as follows:

1. Graphical display of remaining battery life
2. Graphical display of remaining fluid in each fluid cartridge
3. Counter of total puffs taken
4. Ability to change the "variable voltage" setting of each heater independently.
5. Ability to run diagnostics on the device to ensure proper function and for troubleshooting by customer service
6. Integration to a central website/server.
7. "Send to Device" button for uploading changes to the device.
8. Ability to connect to the a server for GUI and product updates In another configuration, a plastic battery housing (which includes the main PCBA, 142, with potentiometers for heater control, battery, 144, speaker, microphone, USB/GUI connection, 114, OLED screen, 112, toggle button, 116), a mouthpiece housing/cartridge access door, 108, e-liquid, 106 and heater cartridges, 104, air sensor, 146, a button mechanism to slide out the mouthpiece for use.

Some advantages of this embodiment include: mimic that of the preferred embodiment but give the user an OLED screen and rocker button that allows them to interact with their device manually. In addition the e-liquid cartridge and heating cartridge are separate, allowing for less waste per change out. The front assembly, 108, snaps into the battery assembly, 102, via a guide post and snap feature. The front assembly is the end that the user puts their mouth on to vaporize. The user can opt to use the mouth tip feature, or when the mouth tip, 120, is retracted they can just suck on the end of the front assembly at the elliptical opening.

Figure 6:
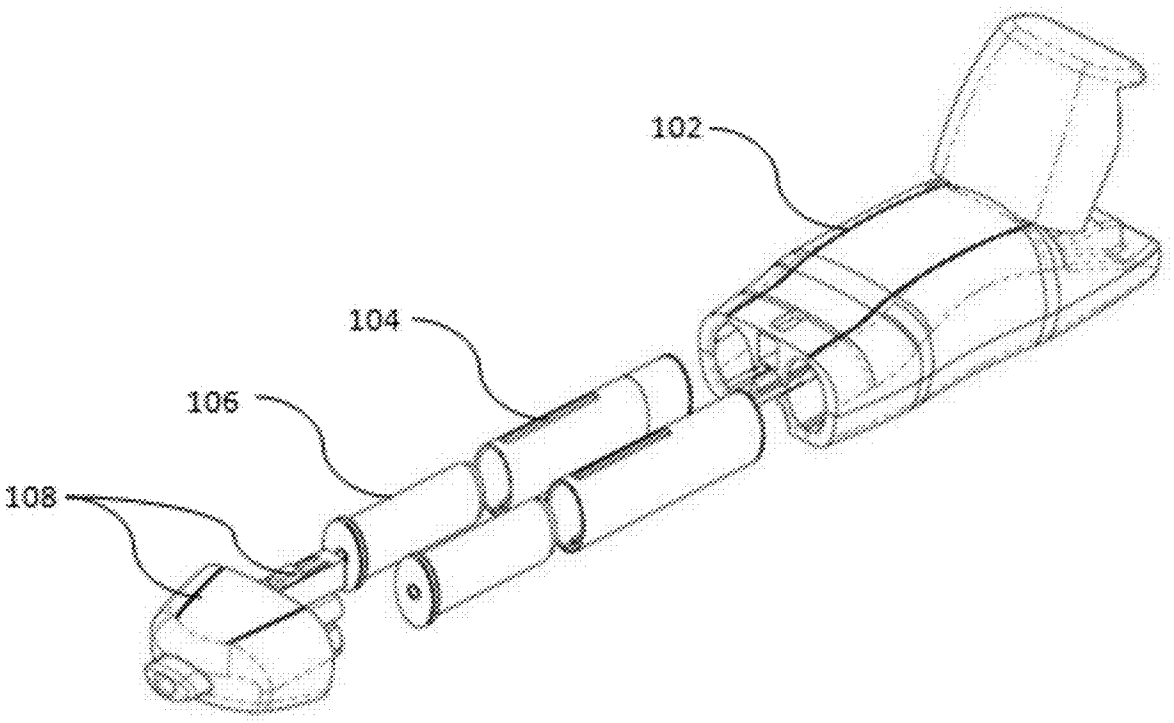
FIG. 6 is separated perspective view of a two-cartridge embodiment.
Figure 7:
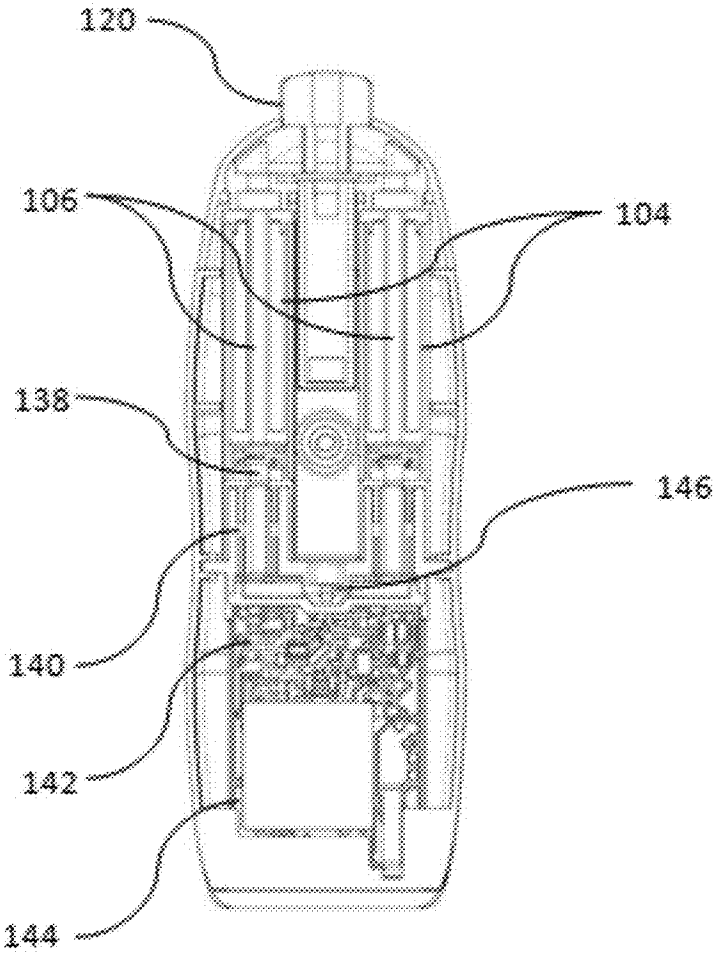
FIG. 7 is perspective view showing an open and closed unit.
Figure 8:
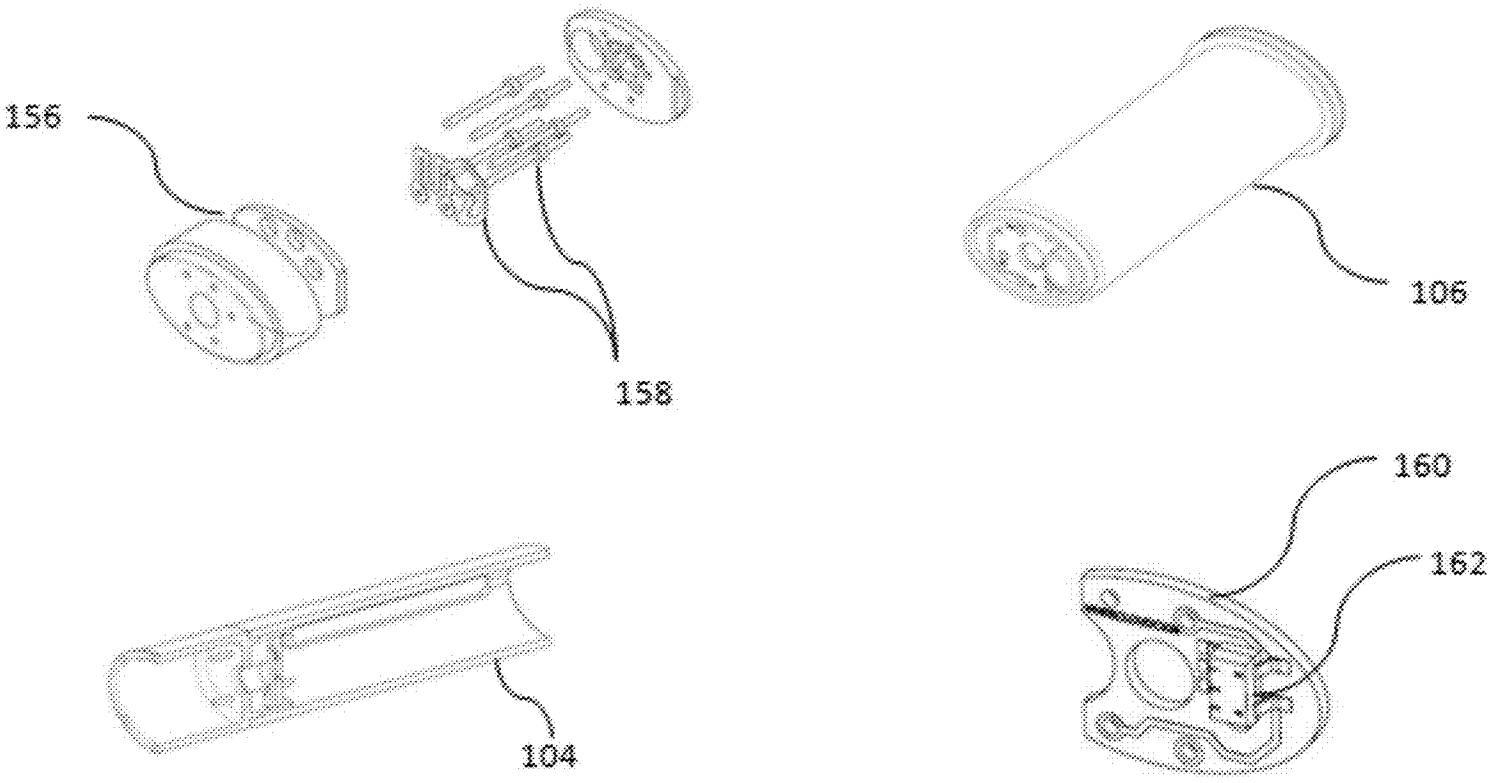
FIG. 8 is a plan view of interior components.
Figure 9:
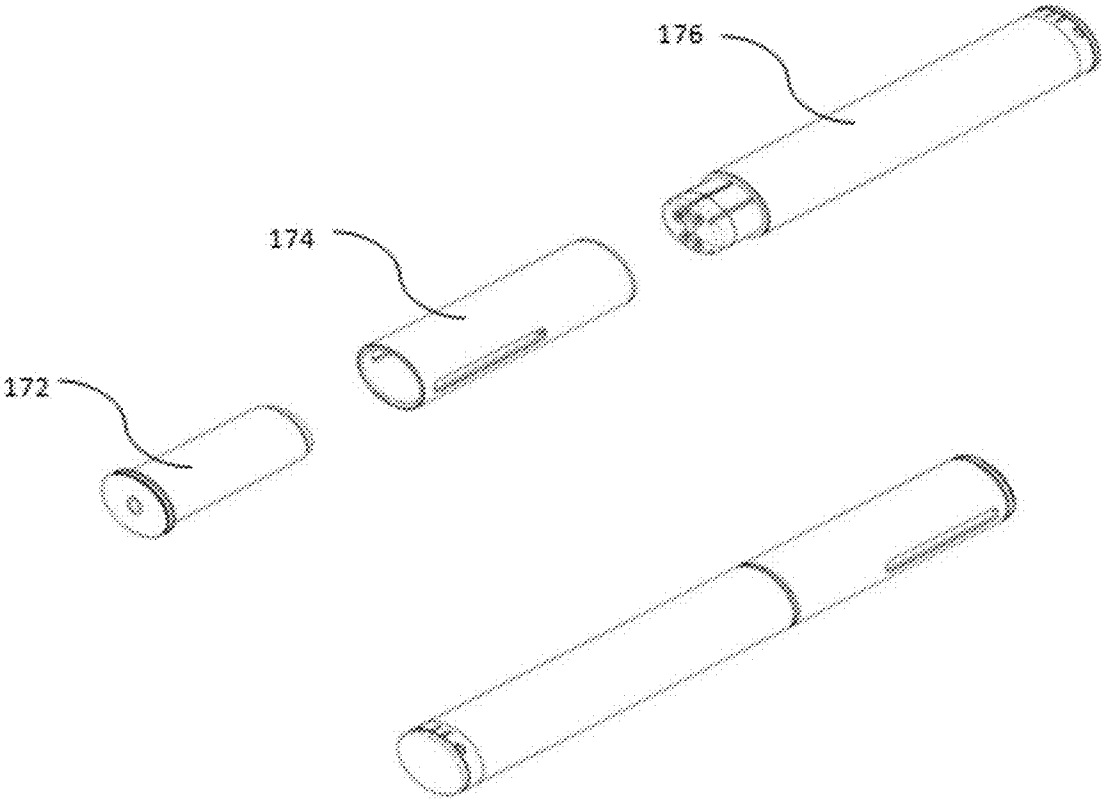
FIG. 9 shows separated and assembled views of one embodiment.
Figure 10:
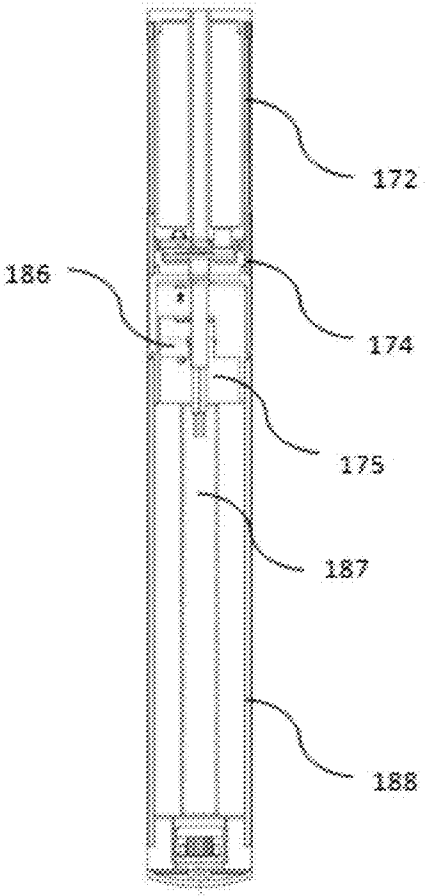
FIG. 10 is a view of internal components of the tip and body.
Figure 10:
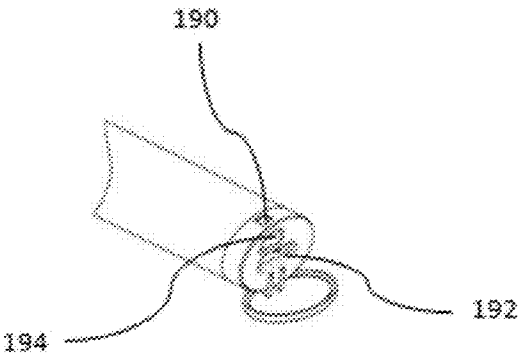
Figure 11:
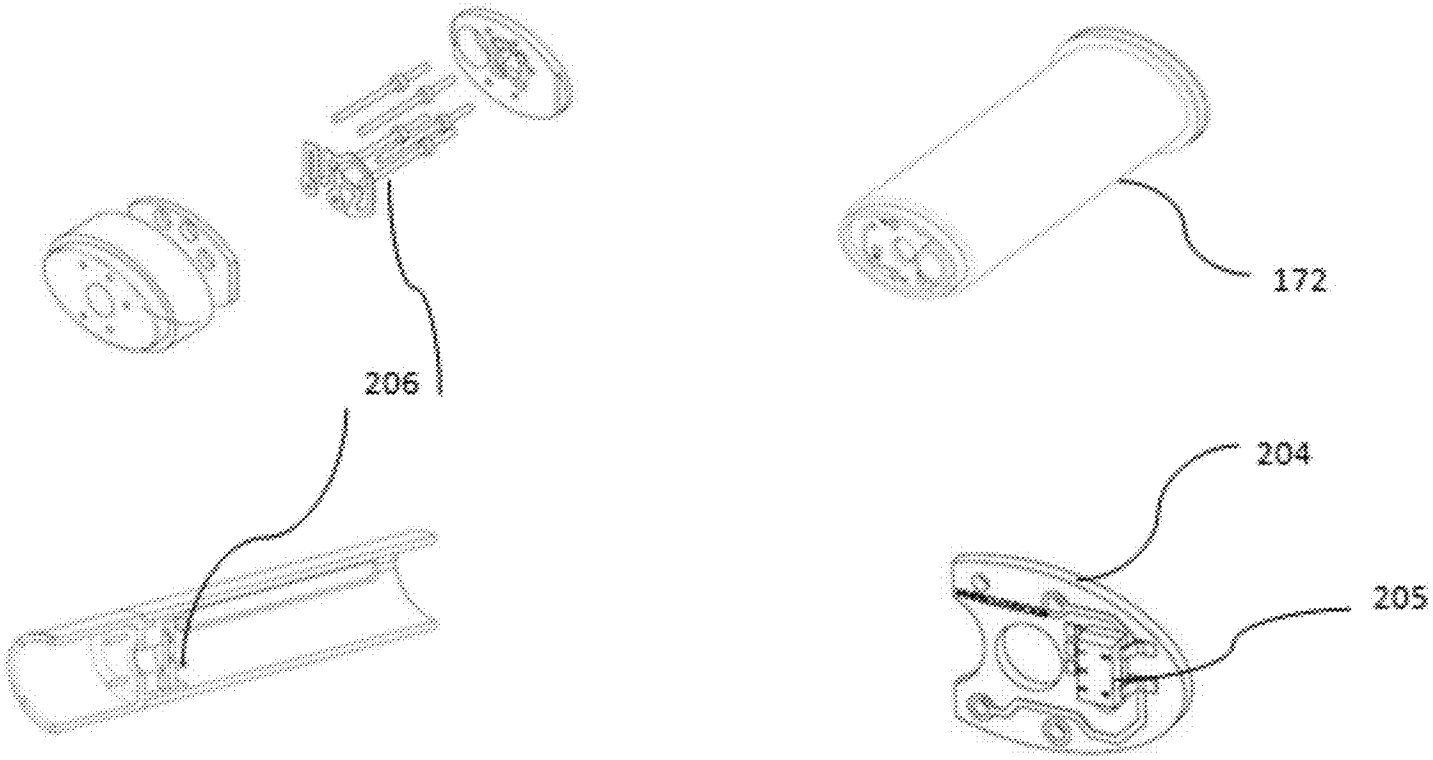
FIG. 11 shows multiple internal components.
Figure 12:
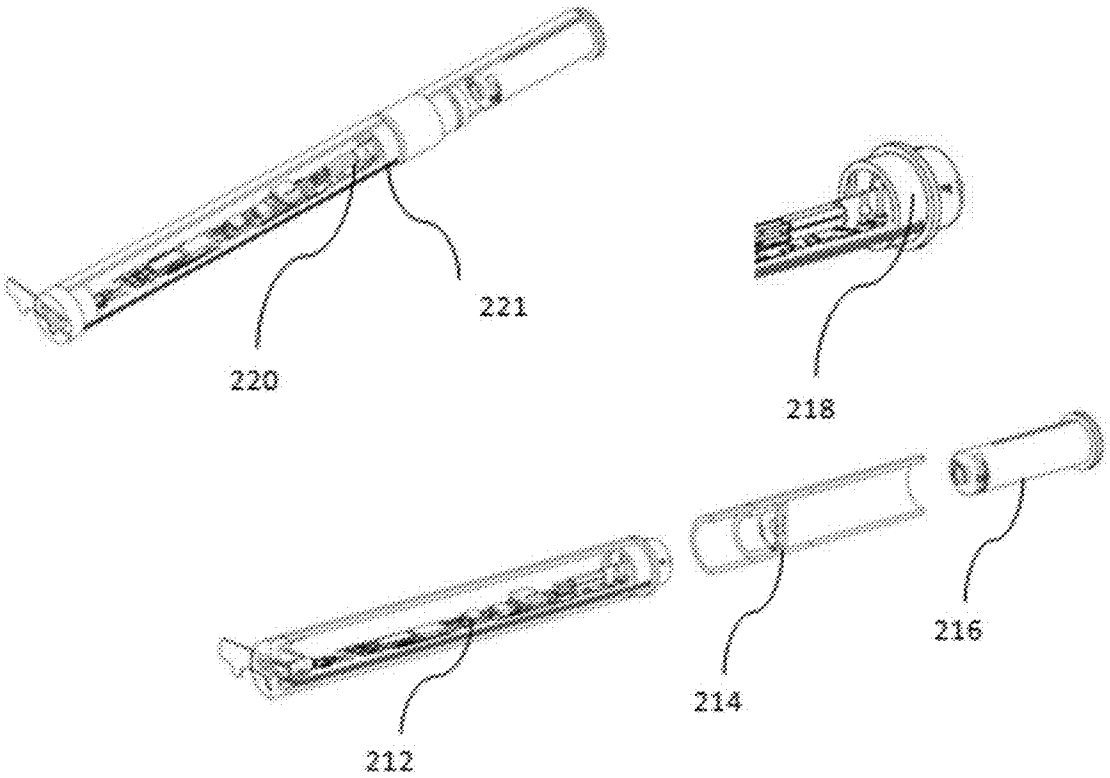
FIG. 12 is a view of internal components of the invention.
Figure 13:
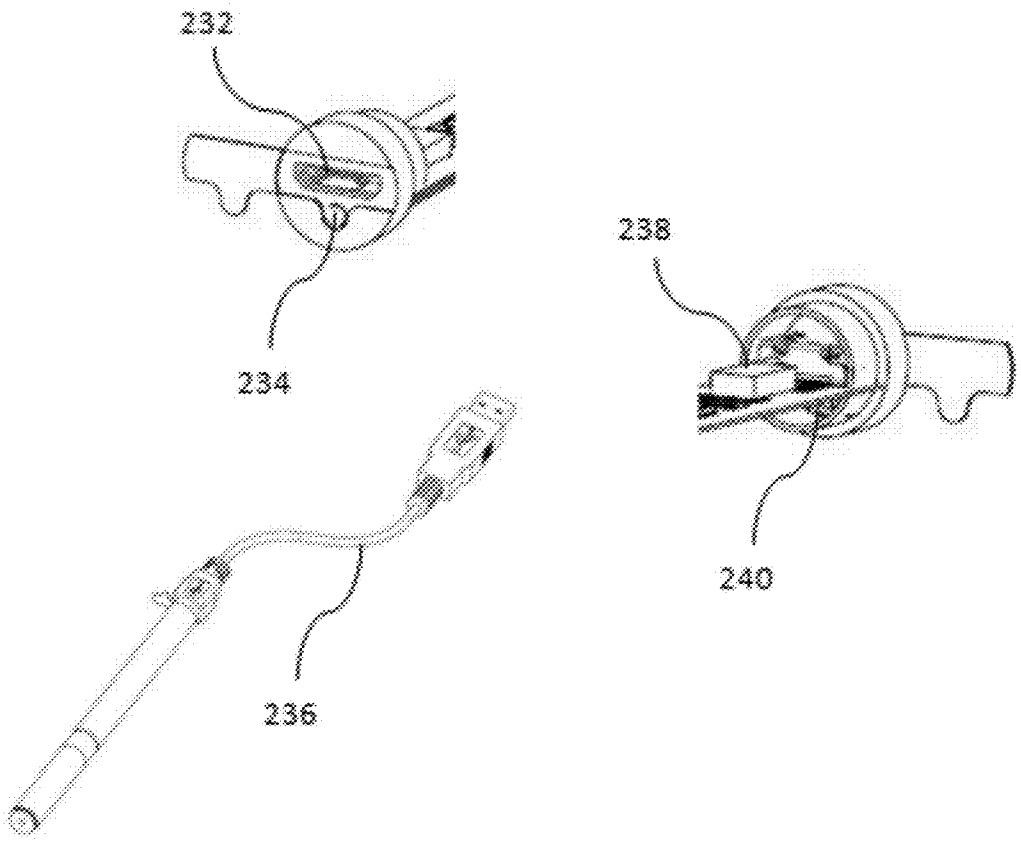
FIG. 13 shows detailed view of several internal components.
Figure 15:
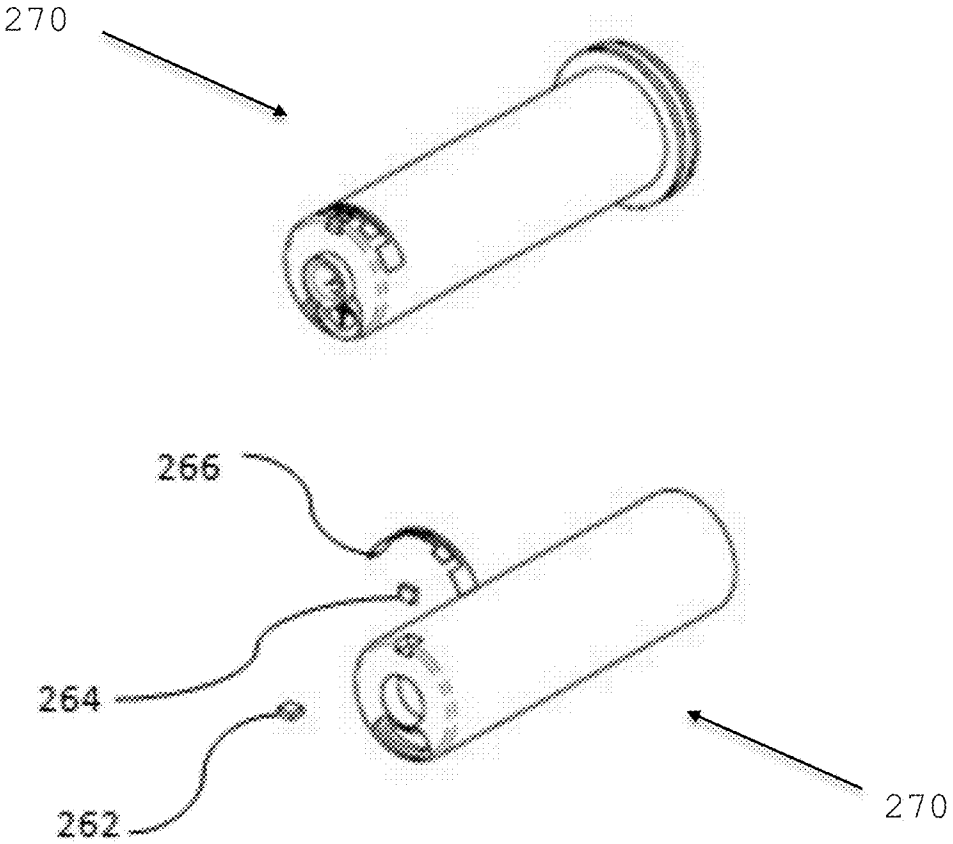
FIG. 15 shows one embodiment of a liquid cartridge of the present invention with heating component associated therewith.

As shown in FIGS. 6-8, the present invention has an extendable/retractable mouth tip 120, made of soft rubber material contained in the front assembly, 108. This tip is moved forward by sliding the switch on the underneath of the housing, thus extending the tip. When a user is done (s)he can store the tip back inside the unit by sliding the switch in the reverse manner. The tip is also interchangeable for hygienic purposes and can be changed to various shaped tips for personal preference.

Liquid Cartridges:

When users want to change or insert the liquid cartridges, 106, they will push in the snap release, on the front assembly, 108, and pull the front assembly 108 off the unit. Users will then pull the old liquid cartridges 106 to remove them. Once removed users will insert new cartridges 106 until they click into place. Users will notice the cartridges will only go in one orientation.

Heater Cartridges:

To change the heater cartridges, 104, users will push in the snap release on the front assembly, 108, and remove the front assembly. Next a user will pull out the liquid cartridge assemblies, 106. Then grasp the heater cartridge, 104, one at a time and pull out and dispose of the unit. Each heater cartridge assembly is good for approx. 5 liquid cartridge assembly uses. This eliminates the need for throwing away the heater assembly every time a user changes liquid cartridges.

Battery Assembly:

The battery assembly, 102, has an access door, 118, that is translucent to let the user be able to see signals from the OLED screen, 112. The door is also hinged to allow the user to open the door and access the OLED screen, 112, micro usb, 114, and the rocker switch, 116, for manipulating modes on the screen.

PCB:

The proposed PCB, 142, for the new unit will be a rigid PCB in the battery assembly, 102. The vacuum switch has been removed. Activation now takes place via an airflow sensor, 146. The PCB houses an Air Flow Sensor, 146, at the anode collar, 140. The proposed PCB is a 2-layer board with all SMT components mounted to top and bottom. There are two separate liquid cartridges, 106, each with their own heater, 104, controlled by a Digital Potentiometer allowing for variable heater intensity and combining of flavors. The connections to the heater and AUTHENTICAION go through a custom anode, 140, using conductive inks. The battery, 144, connects to the board using a Molex wire-to-board assembly. The PCB also includes an OLED display, 112, controlled with a rocker switch, 116.

Air Flow Sensor:

The unit of the present invention will allow the user to identify the remaining fluid in their cartridge without having to remove the cartridge or do a visual check. By utilizing an Air Flow Sensor (AFS), 146, embedded into the center of the anode collar the new unit will be able to sense when there is a change in air flow, i.e. a user taking a puff. This will be used for heater activation; by obtaining the duration of the puff, a user is able to accurately predict the amount of liquid used in that puff.

Upon inserting a new liquid cartridge into the heater assembly and taking the first puff, the AFS passes this information to the microcontroller. The microcontroller calculates the amount of fluid used and passes that information to the AUTHENTICAION, 162. The AUTHENTICAION acts as an accumulator. Once users reach 110% accumulation the unit no longer will activate the heater until a new liquid cartridge is inserted. The purpose of allowing the unit to achieve 110% is to allow for a 10% margin of error in liquid level calculation.

As the user depletes the liquid in the cartridge they are notified of the remaining liquid level via the OLED, 112. This feature allows the user to easily identify when a new liquid cartridge is needed. Once the user reaches −10% the OLED flashed red and a new liquid cartridge must be inserted.

The AFS from a technical aspect:

The PTFD10 is a thermal flow sensor die that measures the flow of a gaseous medium across the die using the thermo transfer (calorimetric) principle. The sensor die is comprised of a central heater element (resistor), and two clusters of 20 thermocouples each positioned symmetrically up and downstream of the heater. The upstream thermocouples are cooled by the flow and the downstream ones are heated due to heat transport from the heater in the flow direction. The output signal is the differential voltage of up and downstream thermocouples.

This unit offers two key advantages over traditional MEMS flow sensors. First, thermocouples are used for temperature sensing instead of resistors, achieving ultra-low noise to signal, and enabling simplified circuitry. Second, an innovative solid thermal isolation base is used for the heater and the hot junctions of the thermocouples, eliminating fragile membrane or surface cavity.

Operating Temperature: −40 C to 125 C

Overpressure: 15 bar (217 PSI)

Heating Current: 6.5 mA

Response Time: 3 ms

Microphone:

In another embodiment of the present invention will allow the user to identify the remaining fluid in their cartridge without having to remove the cartridge or do a visual check. By utilizing a microphone embedded into the center of the anode collar the new unit will be able to sense when there is a puff occurring by listening for the sound of inhalation. The frequency of the sound of inhalation should remain constant due to the configuration of the air intake holes on the device. When a user puffs on the device air is drawn into the unit, this air creates a sound based on the configuration of the holes. The microphone is tuned to the frequency of this sound and activates based on it. The microphone will not activate based on any other sound, thereby removing the possibility of a false activation.

This alone will be used for heater activation; by obtaining the duration of the puff, users should be able to accurately predict the amount of liquid used in that puff.

Upon inserting a new liquid cartridge into the heater assembly and taking the first puff the microphone passes this information to the microcontroller. The microcontroller calculates the amount of fluid used and passes that information to the authentication, 162. The authentication acts as an accumulator. Once users reach 110% accumulation the unit no longer will activate the heater until a new liquid cartridge is inserted. The purpose of allowing the unit to achieve 110% is to allow for a 10% margin of error in liquid level calculation.

As the user depletes the liquid in the cartridge, they are notified of the remaining liquid level via the OLED. This feature allows the user to easily identify when a new liquid cartridge is needed. Once the user reaches −10% the OLED flashed red and a new liquid cartridge must be inserted.

Microphone from a Technical Aspect:

Analog Devices—ADMP404

The ADMP404 is a high quality, high performance, low power, and analog output bottom-ported omnidirectional MEMS microphone. The unit includes a MEMS microphone element, an impedance converter, and an output amplifier. The sensitivity specifications make it an excellent choice for near field applications. The unit has a high SNR and flat, wideband frequency response, plus its low current consumption enables long battery life for portable applications. The ADMP404 is halide free.

One preferred configuration is in Table 7 below:

| Parameter | Symbol | Test Conditions/Comments | Min | Typ | Max | Unit |
|---|---|---|---|---|---|---|
| PERFORMANCE | | | | | | |
| Directionality | | | | Omni | | |
| Sensitivity | | 1 kHz, 94 dB SPL | −41 | −38 | −35 | dBV |
| Signal-to-Noise Ratio | SNR | | | 62 | | dBA |
| Equivalent Input Noise | EIN | | | 32 | | dBA SPL |
| Dynamic Range | | Derived from EIN and maximum acoustic input | | 88 | | dB |

-continued

| Parameter | Symbol | Test Conditions/Comments | Min | Typ | Max | Unit |
|---|---|---|---|---|---|---|
| Frequency Response | | Low frequency −3 dB point | | 100 | | Hz |
| | | High frequency −3 dB point | | 15 | | kHz |
| | | Deviation limits from flat response within pass band | | −3/+2 | | dB |
| Total Harmonic Distortion | THD | 105 db SPL | | | 3 | % |
| Power Supply Rejection | PSR | 217 Hz, 100 mVp-p square wave superimposed on VDD = 1.8 V | | 70 | | dB |
| Maximum Acoustic Input | | Peak | | 120 | | dB SPL |
| POWER SUPPLY | | | | | | |
| Supply Voltage | VDD | | 1.5 | | 3.3 | V |
| Supply Current | IS | | | | 250 | μA |
| OUTPUT CHARACTERISTICS | | | | | | |
| Output Impedance | ZOUT | | | 200 | | Ω |
| Output DC Offset | | | | 0.8 | | V |
| Output Current Limit | | | | 90 | | μA |

NVRAM:

In one embodiment, the Liquid Cartridge, 106, will have a 4 pin, SPI interface, and an authentication device such as Non-Volatile Random Access Memory (NVRAM) chip, 162, embedded into the PCBA, 160. The liquid cartridge will have 4 electrical contacts on it, 158, which will supply power and data lines from the authentication to the PCB, 142.

In one embodiment the authentication will contain an identifying serial number for use in quality control, easily allowing the manufacturer to identify product lots in the case of a needed product recall or other customer care issue.

The NVRAM will contain the data as to the current fluid level remaining in the fluid cartridge. This serves four purposes:

1. Provide information to the consumer of the fluid level remaining.
2. Inhibit the user from refilling the cartridge. Once the authentication shows the fluid cartridge to be 110% empty the heater will no longer activate until a new fluid cartridge is inserted.
3. Prevent the user from overheating and damaging the heater when no liquid present.
4. Allow the user to transfer one fluid cartridge to multiple battery and heater assemblies without losing the status of the fluid level.

Concerning number 4 (above), the present invention contemplates a configuration constructed to store all liquid level information on the PCB in the battery assembly. The Microcontroller would be informed of a new liquid cartridge being inserted via a simple switch in the heater assembly that became depressed once a cartridge was inserted. This presented multiple issues for evaluation:

1. Should the current liquid cartridge be removed and re-inserted, the unit would assume a new, full cartridge had been inserted when this may not be the correct state.
2. Should the battery become depleted and the user switched battery assemblies, the new battery assembly would assume a new, full cartridge was in place.

By placing the authentication on the fluid cartridge itself, and storing the liquid level state on it, the invention will bypass the above issues. Each time a puff is taken the microcontroller on the battery PCB makes a call to the authentication to update its usage and reads the previous state. This previous state information is then transmitted back to the battery assembly PCB and a determination is made at to the total liquid level remaining.

Figure 20:
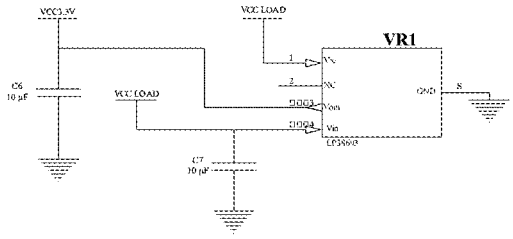
FIG. 20 shows one configuration of NVRAM.

The NVRAM, in one embodiment is desired due to its low price point and durability. Technical information is as follows:

Memory Size: 8 Kbit
Organization: 1K×8
Data Retention: 100 years
Maximum Clock Frequency: 5 MHz
Maximum Operating Current: 5 mA
Operating Supply Voltage: 3.3V
Maximum Operating Temp: +85 C
Package: UDFN
Access Time: 75 ns
Minimum Operating Temp: −40 C
Interface: SPI One preferred shown in FIG. 20.

In one embodiment, the present invention includes a custom socket 138, that has been configured to allow the heater cartridge 104, assembly to make a 90 degree connection to the PCB 142. This socket is an injection molded part which then goes through a 3D-MID process (3D-MID stands for Molded Interconnect Devices or three-dimensional injection molded circuit boards. By integrating mechanical and electronic functions and three-dimensional configuration the optimal usage of space is achieved. Moreover, large scale integration density of mechanical and electronic functions is possible and savings can be made on components and process steps. In turn, this affords a high degree of configuration flexibility to apply conductive inks to the part, effectively turning the molded part into a SMT component for connection to the PCB. The pins of the heater cartridge slide into sockets, which are coated with the conductive ink (mixture of Nickel and Gold). Those sockets then follow traces, which are similar to the copper traces utilized in standard PCB's. The traces make their way to SMT pads, which are then soldered to the board providing a connection from the PCB to the heaters and authentication. Being that the present invention is utilizing two separate heaters and two separate authentication cartridges, the IC Socket has a total of 10 socket connections. The socket also serves as a mount for the activation method (See Microphone and Air Flow Sensor).

In one embodiment, the present invention utilizes two digital potentiometers, one for each heater, to allow the user 5 "heater intensity" settings. These settings range from 2.8V to 3.5V. The user can select the settings via the OLED, 112, or the GUI.

Many manufacturers, regardless of product, will activate devices (a heater in our case) with a variable pulse width modulation scheme (PWM) which creates confusion in what voltage is actually being applied to the heater, and has created much debate in the e-cig arena. The invention has an adjustable regulator that will output a constant DC voltage based on a digital potentiometer. This method is extremely accurate. So if the unit is sending a certain voltage, it will be that voltage without any question. It is not pulsing, it is constant, and so there are no pulse widths to measure and average (Vrms).

The present invention utilizes a 52×36 pixel OLED display, 112. The display will be used to show battery and liquid life in each cartridge, as well as heater intensity of each heater. The OLED is paired with a miniature rocker switch, 116, which allows the user to cycle through the different screens as well as makes changes to the variable voltage function. The logic of the screen and rocker is as follows:

1. The screen is off
2. The user depresses the rocker switch, the screen turns on.
3. The screen displays a logo for 3 seconds.
4. The screen displays the remaining battery life.
5. The user rocks the switch up (they could alternately rock the switch down and start a step 16 and works backwards)
6. The screen displays battery life screen.
7. The user rocks the switch up.
8. The screen displays cartridge 1 life
9. The user rocks the switch up
10. The screen displays cartridge 1 heater intensity
11. The user depresses the switch.
12. The user rocks the switch up to increase the heater intensity or down to decrease it.
13. The user depresses the switch.
14. The user rocks the switch up.
15. The screen displays cartridge 2 life.
16. The user rocks the switch up.
17. The screen displays cartridge 2 heater intensity.
18. The user depresses the switch.
19. Repeat of step 11 for cartridge 2.
20. The user depresses the switch
21. The user rocks the switch up.
22. The screen displays the battery life.

If at any time there is no input for 15 seconds the screen shuts off.

OLED Technical Information:

Organic LED technology

Life 30,000 hours @ 100 cd/m2 (based on 40% pixels on) or 60,000 hours @ 50 cd/m2 (based on 40% pixels on)

Power consumption only 2.4 mA (30% less than previous product)

Range of 65,536 colors in 16 bit mode, 256 colors in 8 bit mode

Full viewing angle of 180°

Exceptional contrast: 50 times greater than LCD products

Four times more enhanced resolution

High resolution provides sharp, clear images of very small characters

Operated by commands and data supplied via serial communications (SPI)

Dust tight construction

The present invention utilizes a prismatic 3.7v 1,300 mAh LiPo rechargeable battery, 144, placed in the top of the unit and connected via a 28 AWG wire-to-board Molex connector for ease in assembly. LiPo was chosen due to its high-energy capacity and low self-discharge rate. LiPo also presents a safer alternative to Li-ion batteries in that they do not create as much heat or swelling during discharge. In addition a LiPo will not typically explode during a catastrophic failure of the casing. The prismatic shape is necessary to maximize the capacity of the battery relative to the space allowed. By increasing the battery capacity to 1,300 mAh the user will enjoy a large increase in time between charging.

Accordingly the battery should provide:

Battery of 1300 mAh converted to seconds is 4,680,000 of 1 mA current.

Assume a 30 second cycle between puffs is a full run cycle; a shorter cycle will only give us more available puffs.

1,600 mA/s for the heaters (assuming max vapor intensity setting)

50 mA for the OLED display 40 mA for pressure sensor/micro and support circuitry So for three seconds unit will consume 1,690 mA×3=5,070 mA and the remaining 27 seconds were in "low power mode" consuming only 5 mA (double our real calculation).

So for 30 seconds unit will consume 5,070+135=5,205 mA seconds of our total 4,680,000.

That means unit will have 4,680,000/5,205=899 30 second periods for a total time of 899/2 (2 per minute)=449.5 minutes or 7.5 hours before the battery dies.

The previous battery provided for 200-300 puffs, our new configuration should allow for 899 puffs per cartridge (total of 1,798 and dependent on vapor intensity setting), a drastic increase.

A fuel gauge will also be implemented onto the PCB to provide the user a readout of their current charge level via the OLED display, which can be checked at any time. When battery is depleted the OLED, 7, will flash red indicating a charge is needed. The fuel Gauge will also provide information to the GUI (graphical user interface) when connected to a computer and provide additional information such as the number of charges to date, the amperage and voltage, and diagnostics.

Battery Technical Information:

Nominal Capacity: 1300 mAh

Nominal Voltage: 3.7V

Charge Current: 1 C5 A

Charge Cut-off Voltage: 4.20+−0.03V

Standard Discharge Current: 0.2 C5 A

Max Discharge Current: 2.005 A

Discharge Cut-Off Voltage: 2.75V

Impedance: <=300 mOhm

Storage Temp: −20-+45 C

Storage Humidity: 65+/−20% RH

Speaker:

A small piezoelectric speaker, similar to those used in inner-ear hearing aids was to be placed on the PCB, 142, in the battery assembly. 102. The speaker would provide status tones for fluid and battery level as well as simulate the crackling sound of a traditional cigarette.

Figure 21:
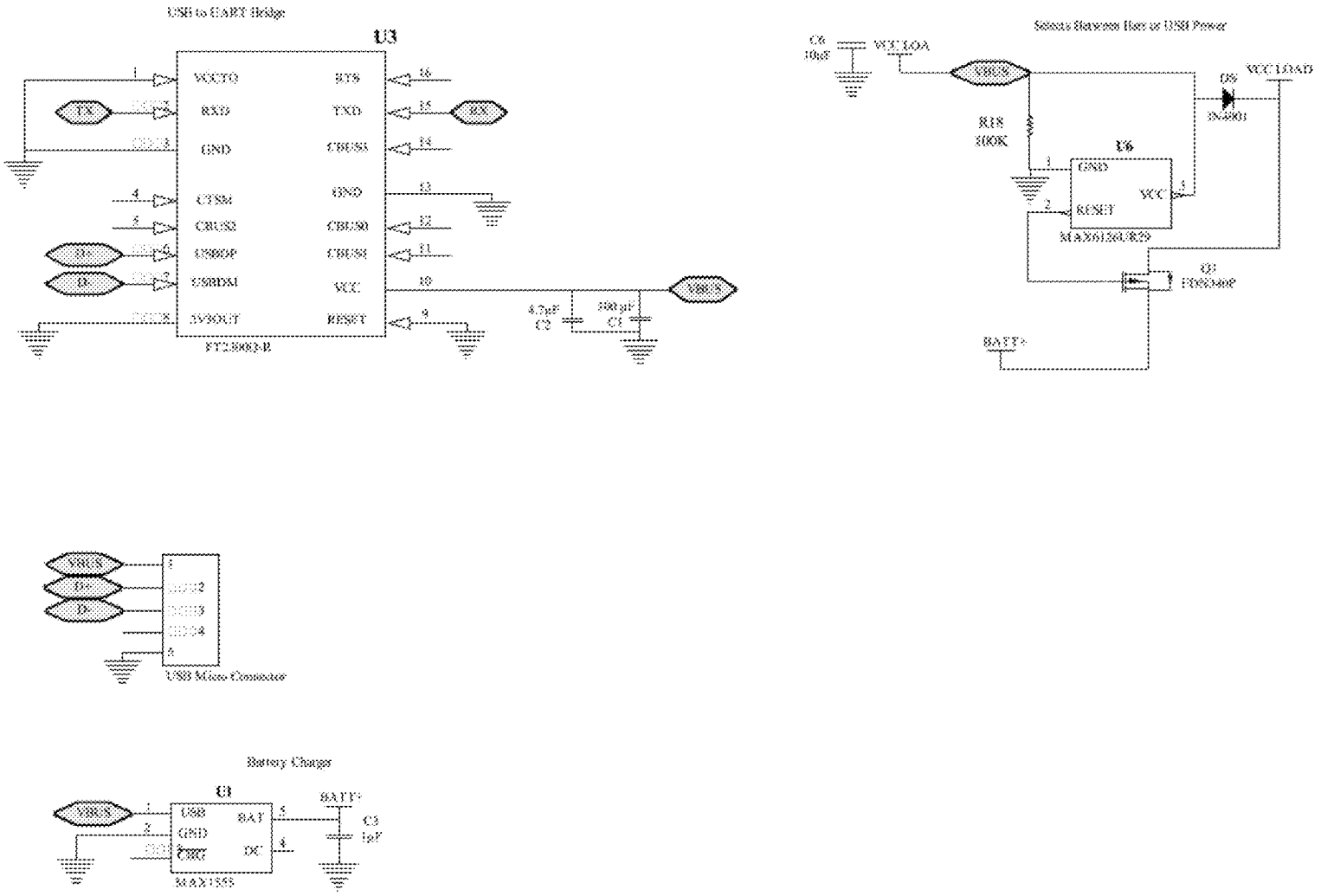
FIG. 21 is a configuration of a device of the invention that will utilize both the data and the 5V electrical lines in the USB with charging circuitry is located on the PCB internally configured to allow connection and allows the user to continue using the electronic cigarette while charging without requiring disassembly.

Micro-USB Type B:

In one embodiment, the present invention incorporates a micro-USB type B female receptacle, 114, that are placed on the PCB, 142. This USB is used in conjunction with a male micro USB type B cable for connection to a standard computer USB port as well as a separate inverter for use in a standard home electrical outlet. The micro-USB serves to charge the device as well as interact with the GUI (see GUI) to control features of the device. The device will utilize both the data and the 5V electrical lines in the USB. All charging circuitry is located on the PCB internally. Additionally this will allow connection to a mobile device such as tablets or smartphones. This configuration allows the user to continue using the electronic cigarette while charging and does not require disassembly of the product as shown in FIG. 21.

GUI (Graphical User Interface):

As shown in FIG. 5, in this embodiment, a GUI has been developed to allow the user to control certain features and monitor certain states of their product. The GUI will initially be available for access on both MAC and PC, with the GUI being stored internally to the device. A further option available to the consumer, once connected to a computer, will be activation via the Internet allowing for additional features and registration of the device. The main features included are as follows:

1. Graphical display of remaining battery life
2. Graphical display of remaining fluid in each fluid cartridge
3. Counter of total puffs taken
4. Ability to change the "variable voltage" setting of each heater.
5. Ability to run diagnostics on the device to ensure proper function and for troubleshooting by customer service
6. Integration to a consumer website
7. "Send to Device" button for uploading changes to the device.
8. Ability to connect to a server for GUI and product updates New Heater Configuration:

1. A new heater configuration, 104, 156, 158, utilizes 1300 mA at every activation, and units are using a 3.7 V 1300 mA hour battery and are creating a vapor of approximately 3.75 μL at each activation. This is a 24% less power usage than the old configuration and a 100% increase in vapor output. The new heater performance in 1.5 seconds is 375° F. and in 2 seconds reaches 390° F. This is due to the new heater configuration that optimizes resistance versus surface area of heater that makes contact with the e liquid. Our new heater configuration is a custom configuration that does not exist in the marketplace right now. The present invention is utilizing a high heat nylon substrate and attaching Nichrome raceways almost in the same manner as laying up a circuit board.

The manufacturing process used to make this heater is also novel. One of the advantages of our new heater configuration is the optimization of the surface area of the metal tracings that actually make contact with the E-liquid, which is wicked on to a fiberglass disc Pad. By creating more surface area of the metal tracings making contact with the actual E liquid to produce more vapor. The old configuration heater utilizing 0.004 in diameter Nichrome wire wrapped around a wick only makes contact with the E liquid by approximately ½ the diameter of the Nichrome wire. This configuration minimizes the wire contact with the liquid thus producing less vapor during each activation. Another advantage of this new heater configuration is a controlled manufacturing process, which produces repeatable results every time a unit is manufactured.

The new method of manufacture for the heater assembly is a controlled manufacturing process that does not allow for the human error factor. This creates a better quality controlled manufactured product. The complete heater pad assembly includes a Nichrome heater subassembly, a scavenging pad which works as a wick for the E liquid, five electronic pins for electronic transmission to electronic components, and an insulation ring which holds the scavenging pad up against the raceways on a high heat resistant plastic perforated disc. The insulation ring holds all the components together and also creates insulation between the heat of the tracings and the outer diameter of the electronic cigarette housing to minimize heat felt by the consumer at the touch of their fingers. Another advantage of this new heater configuration is the capability of assembling all components in an automated assembly sequence. This automated assembly will also eliminate human error and increase the quality of the end product. The new heater assembly configuration is a machine-manufactured configuration. This configuration will not allow for human error factor. Since the invention has an electronic circuit board driving the new heater, the unit includes a software application that will enable, via the GUI software, a user to adjust the heater to a preferred volume of vapor output.

In another embodiment, the present invention overcomes the problems referenced in the background of invention section by providing an oval e-cig configuration to maximize space while still emulating the feel of a traditional round e-cigarette. This configuration includes a liquid cartridge/mouthpiece, 172, heater cartridge, 174 and battery assembly, 176 (which houses the anode, 174, PCBA, 187, vacuum switch, 186, battery, 188, speaker and microphone, micro USB port, 192).

The advantages of this embodiment allow for a larger battery and volume of the e-fluid to be obtained by altering the geometry to an oval shape but not increasing the overall size compared to the conventional round e-cigarettes. In addition a micro USB port is added to the tip to allow users to charge their device without having to remove the e-liquid and heater cartridges. This allows the device to be used while charging.

Liquid Cartridges:

When users want to change or insert the liquid cartridges, 172, they will pull the cartridge out of the heater, 174, and insert new cartridges. Once removed users will insert new cartridges until they click into place. Users will notice the cartridges will only go in one orientation. A SMT LED (red, yellow, green), will be placed on the PCB next to the anode collar, 186, to provide a reading of the available remaining fluid in the fluid cartridge. The LED will activate automatically after every 5 puffs taken. Once the fluid cartridge is empty the LED will flash red. The LED receives its information from the microprocessor and the authentication located on the fluid cartridge. This will provide the user with an easy way of monitoring liquid level without the need to remove the cartridge.

Heater Cartridges:

To change the heater cartridges users will separate the heater assembly, 174, from the battery assembly, 176, by pulling. Next a user will pull out the liquid cartridge assemblies, 172, from the heater, 174. Each heater cartridge assembly is good for approx 5 liquid cartridge assembly uses. This eliminates the need for throwing away the heater assembly every time a user changes liquid cartridges.

PCB:

The PCB, 187, for the present invention will be either a flex or rigid PCB spanning the entire length of the battery assembly, 176. The vacuum switch has been removed. Activation now takes place via a signal from the digital potentiometer. The digital potentiometer receives its signal to activate from either the air flow sensor or microphone.

The PCB houses a pressure transducer, 175, at the anode collar, 186, and Micro USB, 192, at the ash tip. The proposed PCB is a four layer board with all SMT components mounted to top and bottom. The connections to the heater and battery are rigid connections preventing twist and providing for stronger joints.

Pressure Transducer:

There is a window allowing for a visual check if desired however the pressure transducer, 175, will identify the fluid level. By utilizing a pressure transducer embedded into the center of the anode collar the new unit will be able to sense when there is a change in pressure, i.e. a user taking a puff. This alone could be used similar to the "old unit" for heater activation; however, it is not used for this function in the new configuration. Instead, by obtaining the duration and strength (pressure) of the puff, the present invention will be able to accurately predict the amount of liquid used in that puff. Upon inserting a new liquid cartridge into the heater assembly and taking the first puff the pressure transducer, 175, passes this information to the microcontroller. The microcontroller calculates the amount of fluid used and passes that information to the authentication, 205. The authentication acts as an accumulator. Once users reach 110% accumulation the unit no longer will activate the heater until a new liquid cartridge is inserted. One purpose of allowing the unit to achieve 110% is to allow for a 10% margin of error in liquid level calculation.

As the user depletes the liquid in the cartridge they are notified of the remaining liquid level via a LED ring on the anode collar. Green for >60% full, Yellow for >20% full, Red for <20%. This feature allows the user to easily identify when a new liquid cartridge is needed. Once the user reaches −10% the collar flashes red and a new liquid cartridge must be inserted.

NVRAM:

The proposed Liquid Cartridge will have a four pin, SPI interface, Non-Volatile Random Access Memory (NVRAM), 205, chip embedded onto PCBA, 204 or other authentication as descried herein. The liquid cartridge will have 4 electrical contacts on it, which will supply power and data lines from the NVRAM to the PCB.

The authentication will contain an identifying serial number for use in quality control, easily allowing the manufacturer to identify product lots in the case of a needed product recall or other customer care issue.

The authentication will contain the data as to the current fluid level remaining in the fluid cartridge. This serves four purposes:

1. Provide information to the consumer of the fluid level remaining.
2. Inhibit the user from refilling the cartridge. Once the authentication shows the fluid cartridge to be 110% empty the heater will no longer activate until a new fluid cartridge is inserted.
3. Prevent the user from overheating and damaging the heater when no liquid present.
4. Allow the user to transfer one fluid cartridge to multiple battery and heater assemblies without losing the status of the fluid level.

Concerning purpose 4, the present invention, in one embodiment, is configured to store all liquid level information on the PCB in the battery assembly. The Microcontroller would be informed of a new liquid cartridge being inserted via a simple switch in the heater assembly that became depressed once a cartridge was inserted. This presented multiple issues:

1. Should the current liquid cartridge be removed and re-inserted, the unit would assume a new, full cartridge had been inserted when this may not be the correct state.
2. Should the battery become depleted and the user switched battery assemblies, the new battery assembly would assume a new, full cartridge was in place.

By placing the authentication on the fluid cartridge itself, and storing the liquid level state on it, the invention bypasses the above issues. Each time a puff is taken the microcontroller on the battery PCB makes a call to the authentication to update its usage and reads the previous state. This previous state information is then transmitted back to the battery assembly PCB and a determination is made at to the total liquid level remaining, activating the Liquid Cartridge Level LED.

The NVRAM is desirable in one embodiment due to low price point and durability. Technical information is as follows:

Memory Size: 8 Kbit
Organization: 1K×8
Data Retention: 100 years
Maximum Clock Frequency: 5 MHz
Maximum Operating Current: 5 mA
Operating Supply Voltage: 3.3V
Maximum Operating Temp: +85 C
Package: UDFN
Access Time: 75 ns
Minimum Operating Temp: −40 C
Interface: SPI Digital Potentiometer:

The new unit utilizes one digital potentiometer to allow the user 5 "heater intensity" settings. These settings range from 2.8V to 3.5V. The user can select the settings via GUI, FIG. 5.

Manufacturers, regardless of product, will activate heaters with a variable pulse width modulation scheme (PWM), which creates confusion in what voltage is actually being applied to the heater. In this configuration an adjustable regulator that will output a constant DC voltage based on a digital potentiometer.

This method is extremely accurate.

LiPo Battery:

A custom "D" shaped 3.7v 850 mAh LiPo rechargeable battery, 188, will be wrapped around the rigid PCB in the battery cartridge. LiPo was chosen due to its high energy capacity and low self-discharge rate, as well as its ability to be custom shaped to the applications needs. LiPo also presents a safer alternative to Li-ion batteries in that they do not create as much heat or swelling during discharge. In addition a LiPo will not typically explode during a catastrophic failure of the casing. The "D" shape is necessary to maximize the capacity of the battery relative to the space allowed. Being that the PCB sits uneven in the battery cartridge the battery itself has to be larger on one side and smaller on the other, or a shape similar to the letter "D". The battery will have two rigid connections to the PCB decreasing the failure potential presently seen in light wire gauges. By increasing the battery capacity to 850 mAh the user will enjoy a large increase in time between charging.

Accordingly following calculations for our battery should provide:

Battery of 850 mAh converted to seconds is 3,060,000 of 1 mA current.

Assume a 30 second cycle between puffs is a full run cycle, a shorter cycle will only give us more available puffs.

800 mA/s for the heater.

50 mA for the LED's (this is double our realistic amount)

40 mA for pressure sensor/micro and support circuitry

So for three seconds consume 890 mA×3=2670 mA and the remaining 27 seconds were in "low power mode" consuming only 5 mA (double our real calculation).

So for 30 seconds consume 2670+135=2,805 mA seconds of our total 3,060,000.

That means e cigs of the invention have 3,060,000/2,805=1,091 30 second periods for a total time of 1091/2 (2 per minute)=546 minutes or 9.09 hours before the battery dies.

The previous battery provided for 200-300 puffs, the invention allows for 1,091 puffs, a drastic increase.

A fuel gauge will also be implemented onto the PCB to provide the user a read out of their current charge level via a LED (see Ash Tip LED) on the ash tip, which can be checked at any time by pressing and holding the ash tip push button for 1 second. When battery is depleted the ash tip will flash red indicating a charge is needed. The fuel Gauge will also provide information to the GUI (graphical user interface) when connected to a computer and provide additional information such as the number of charges to date, the amperage and voltage, and diagnostics.

Battery Technical Information:

Nominal Capacity: 850 mAh

Nominal Voltage: 3.7V

Charge Current: 1 C5 A

Charge Cut-off Voltage: 4.20+−0.03V

Standard Discharge Current: 0.2 C5 A

Max Discharge Current: 2.005 A

Discharge Cut-Off Voltage: 2.75V

Impedance: <=300 mOhm

Weight: 10 g

Storage Temp: −20-+45 C

Storage Humidity: 65+/−20% RH

A SMT LED RGB (red, blue, green), 190, will be placed on the PCB near the ash tip, and will glow when the user is inhaling to simulate burning ash on a traditional cigarette. A push button, 194, on the battery end, ash tip, will allow the user to select between six colors via color mixing as well as turning the LED completely off by a quick depress of the button. The seven modes will cycle upon pushing the button, e.g. ash tip is red, seven pushes of the button to be at the back a red ash tip. By allowing the user to change the ash tip color to another color, or off, helps reduce the similarity to a real cigarette thereby avoiding confusion in public.

The ash tip LED will also serve as a battery fuel indicator. Receiving its information from the Fuel Gauge located on the PCB, the LED will provide readout of the current battery charge. When the user depresses the pushbutton for one (1) second the LED will illuminate red, yellow, or green to alert the user to the state of charge. The user will automatically be informed with each state change after a puff. As an example, should the state change from green to yellow, the user will be automatically informed via the ash tip glowing yellow for one second after a puff is taken. The ash tip will also flash red once the battery is fully discharged.

Figure 22:
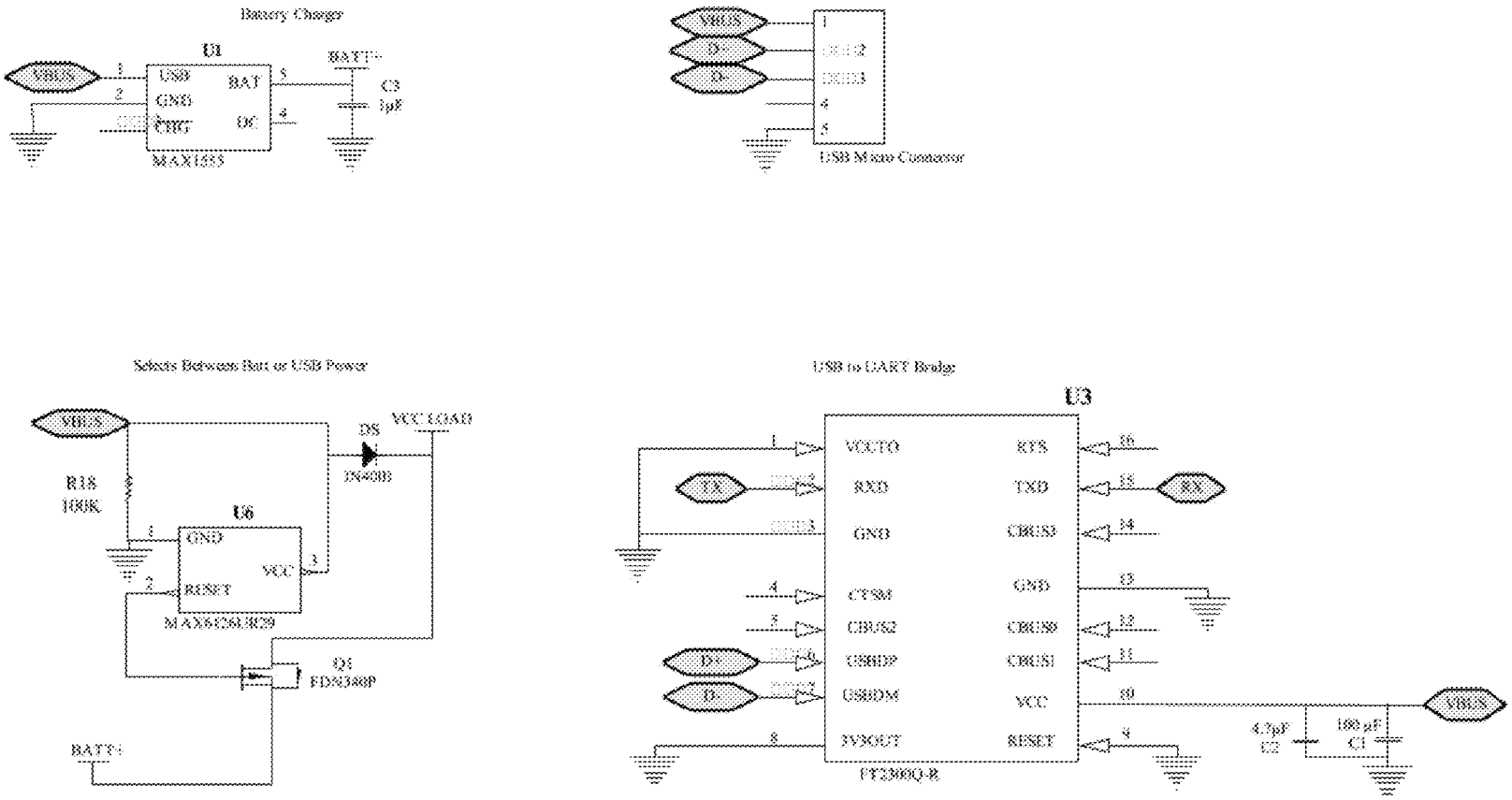
FIG. 22 demonstrates one configuration of the present invention.

Micro-USB Type B:

The present invention provides a new dongle for charging and also has a micro-USB type B female adapter, 192, at the ash tip end for attaching to either a computer or adapters and at the opposite another dongle has a micro USB connection. This is a simple push pull connection very typical of an average cell phone connection. No chance of over twisting or destroying the battery. When users plug in the new dongle micro USB adapter and improved battery configuration and circuit configuration, the present invention provides it will take between 15 min. and 40 min. to charge the new battery as well as the user is still able to use the device while charging. The micro-USB serves to charge the device as well as interact with the GUI (see GUI) to control features of the device as shown in FIG. 22.

GUI (Graphical User Interface):

A GUI, FIG. 5, has been developed to allow the user to control certain features and monitor certain states of their product. The GUI will initially be available for access on both MAC and PC, with the GUI being stored internally to the device. A further option available to the consumer, once connected to a computer, will be activation via the Internet allowing for additional features and registration of the device. Additional versions are being developed to operate on mobile devices such as tablets and smartphones. A sample of the GUI display is show below. The main features included are as follows:

1. Graphical display of remaining battery life
2. Graphical display of remaining fluid in fluid cartridge
3. Counter of total puffs taken
4. Ability to turn off battery level LED
5. Ability to turn off Fluid level LED
6. Ability to run diagnostics on the device to ensure proper function and for troubleshooting by customer service
7. Integration to a consumer website
8. "Send to Device" button for uploading changes to the device.
9. Ability to connect to a consumer server for GUI and product updates New Heater Configuration:

The heater configuration, 206, utilizes 800 mA at every activation, and is using a 3.7 V 800 mA hour battery and is creating a vapor of approximately 3.75 μL at each activation. This is a 24% less power usage than the old configuration and a 100% increase in vapor output. The new heater performance in 1.5 seconds is 375° F. and in 2 seconds reaches 390° F. This is due to the new heater that optimizes resistance versus surface area of heater that makes contact with the e liquid. The new heater configuration is a custom configuration that does not exist in the marketplace right now. The invention is utilizing a high heat plastic housing substrate and attaching Nichrome raceways in a stamped or laser cut manufacture process. The manufacturing process used to make this heater is a new configuration. One of the advantages of the new heater configuration is the optimization of the surface area of the metal tracings that actually make contact with the E liquid, which is wicked on to a fiberglass disc Pad. By creating more surface area of the metal tracings making contact with the actual E liquid produces more vapor. The old configuration heater utilizing 0.004 in diameter Nichrome wire wrapped around a wick only makes contact with the E liquid by approximately ½ the diameter of the Nichrome wire. This configuration minimizes the wire contact with the e-liquid thus producing less vapor during each activation. Another advantage of this new heater configuration is a controlled manufacturing process, which produces repeatable results every time a unit is manufactured.

The old method allows for the human error factor. The new method of manufacture for the heater assembly is a controlled manufacturing process that does not allow for the human error factor. This creates a better quality controlled manufactured product. The complete heater pad assembly includes of a Nichrome heater subassembly, a scavenging pad which works as a wick for the E liquid, five electronic pins for electronic transmission to electronic components, and an insulation ring which holds the scavenging pad up against the raceways on a high heat plastic perforated disc. The insulation ring holds all the components together and also creates insulation between the heat of the tracings and the outer diameter of the electronic cigarette housing to minimize heat felt by the consumer at the touch of their fingers. Another advantage of this new heater configuration is the capability of assembling all components in an automated assembly sequence. This automated assembly will also eliminate human error and increase the quality of the end product. The new heater assembly configuration is a machine-manufactured configuration. This configuration will not allow for human error factor. Since an electronic circuit board is driving the new heater, the present invention includes software application that will enable us via the GUI software to adjust the heater to a preferred volume of vapor output via a digital potentiometer located on the main PCB. Adjusting the voltage and amperage to the heating element will control this.

On one embodiment, the present invention overcomes the problems referenced in the background of invention section by including of a round e-cig configuration similar to current products but reduces the inefficiencies. This configuration includes a liquid cartridge/mouthpiece, 216, heater cartridge, 214 and battery assembly, 212 (which houses the anode, 218, PCBA, 220, vacuum switch, battery, speaker and microphone).

Liquid Cartridges:

When users want to change or insert the liquid cartridges, 216, they will pull the cartridge out of the heater, 214, and insert new cartridges. Once removed users will insert new cartridges until they click into place. Users will notice the cartridges will only go in one orientation. A SMT LED (red, yellow, green) will be placed on the PCB next to the anode collar, 218, to provide a reading of the available remaining fluid in the fluid cartridge. The LED will activate automatically after every 5 puffs taken. Once the fluid cartridge is empty the LED will flash red. The LED receives its information from the microprocessor and the authentication located on the fluid cartridge. This will provide the user with an easy way of monitoring liquid level without the need to remove the cartridge.

Heater Cartridges:

To change the heater cartridges users will separate the heater assembly, 214, from the battery assembly, 212, by pulling. Next a user will pull out the liquid cartridge assemblies, 216, from the heater, 214. Each heater cartridge assembly is good for approximately 5 liquid cartridge assembly uses. This eliminates the need for throwing away the heater assembly every time a user changes liquid cartridges.

Capacitive touch technology of the present invention has been implemented into the liquid cartridge, 216. This technology is based on capacitive coupling, which takes human body capacitance as input. In one embodiment the electrical contact 266 is media used for sensing, and is a copper ring, 266. The copper ring was chosen over other methods of Indium tin oxide (ITO) and printed ink due to its lower price point and ease of assembly. Size and spacing of the capacitive touch sensor have proven to be very important to the sensor's performance. In addition to size and spacing the type of ground plane was also taken into consideration. With the sensor being parasitized, the proposed Vectra material provides an excellent ground plane due to its ability to limit the concentration of e-field lines when no conductive object is present.

While the sensor itself is important, the software and hardware running it are equally important. Being that the heater assembly is a semi-disposable product it is cost prohibitive to place the hardware and software in the heater assembly. All hardware and software are housed on the main PCB in the battery cartridge allowing the sensor to be swapped out with a new one as needed. By tweaking the software we are able to reduce the false activations caused by fingers so that the heater should only activate in the presence of lips coming in contact with the sensor. To our knowledge this is the first time capacitive touch has been used in this manner as most applications seek activation with the fingers.

It is of note that the type of capacitive sensing system used is "absolute capacitance" as opposed to "mutual capacitance". In absolute capacitance the lips load the sensor, or increase the capacitance to ground.

The major benefit of using capacitive touch technology is that the user must first place their lips on the device prior to inhaling. Though this time period is short, it does allow the heater to start heating up prior to the user inhaling, thereby increasing the total vapor received per puff. To our knowledge the only other offering in the market that allows pre-heating requires the user to press a tactile button to activate the heater, with the heater staying active as long as the user holds the button down.

Air Flow:

The present invention has a unit airflow enters in at the anode collar, 218, through vent holes through the anode colors, through the silicone seal, into the heater assembly exiting the heater assembly into an air cooling chamber, and then through a hollow tube in the center of the liquid assembly cartridge assembly and into a user's lungs. The advantage of this configuration is we do not pull any air across the circuit board or the battery, which may leak vapors. We get a clean airflow from the outside atmosphere through our heater assembly through our cooling chamber and straight into a user's lungs. The illustration below represents this airflow and our new configuration.

PCB:

The PCB, 220, unit of the present invention provides for a new unit that will be either a flex or rigid PCB spanning the entire length of the battery assembly. The vacuum switch has been removed. Activation now takes place via a capacitive touch sensor. The PCB houses a pressure transducer at the anode collar, 218 and Micro USB, 232, at the ash tip configured to receive USB plug 236. The proposed PCB is a 4-layer board with all SMT components mounted to top and bottom. The connections to the heater and battery are rigid connections preventing twist and providing for stronger joints. The new PCB configuration will also ease assembly by being able to simply slide into the plastic housing and snap on the ash tip and anode collar.

Pressure Transducer:

There is a window allowing for a visual check if desired however the pressure transducer, 221 will identify the fluid level. By utilizing a pressure transducer embedded into the center of the anode collar the new unit will be able to sense when there is a change in pressure, i.e. a user taking a puff. This alone could be used similar to the "old unit" for heater activation; however, it is not used for this function in the new configuration. Instead, by obtaining the duration and strength (pressure) of the puff, the present invention will be able to accurately predict the amount of liquid used in that puff. Upon inserting a new liquid cartridge into the heater assembly and taking the first puff the pressure transducer, 221, passes this information to the microcontroller. The microcontroller calculates the amount of fluid used and passes that information to the authentication, 262. The NVRAM acts as an accumulator. Once users reach 110% accumulation the unit no longer will activate the heater until a new liquid cartridge is inserted. One purpose of allowing the unit to achieve 110% is to allow for a 10% margin of error in liquid level calculation.

As the user depletes the liquid in the cartridge they are notified of the remaining liquid level via a LED ring on the anode collar, 218. Green for >60% full, Yellow for >20% full, Red for <20%. This feature allows the user to easily identify when a new liquid cartridge is needed. Once the user reaches −10% the collar flashes red and a new liquid cartridge must be inserted.

Microphone:

The new unit will allow the user to identify the remaining fluid in their cartridge without having to remove the cartridge or do a visual check. By utilizing a microphone, 238, embedded into the center of the anode collar the new unit will be able to sense when there is a puff occurring by listening for the sound of inhalation. The frequency of the sound of inhalation should remain constant due to the configuration of the air intake holes on the device. When a user puffs on the device air is drawn into the unit, this air creates a sound based on the configuration of the holes. The microphone is tuned to the frequency of this sound and activates based on it. The microphone will not activate based on any other sound, thereby removing the possibility of a false activation. This alone will be used similar to the "old unit" for heater activation; By obtaining the duration of the puff, we should be able to accurately predict the amount of liquid used in that puff.

Upon inserting a new liquid cartridge into the heater assembly and taking the first puff the microphone passes this information to the microcontroller. The microcontroller calculates the amount of fluid used and passes that information to the authentication. The authentication acts as an accumulator. Once we reach 110% accumulation the unit no longer will activate the heater until a new liquid cartridge is inserted. The purpose of allowing the unit to achieve 110% is to allow for a 10% margin of error in liquid level calculation.

As the user depletes the liquid in the cartridge they are notified of the remaining liquid level via a LED ring on the anode collar. Green for >60% full, Yellow for >20% full, Red for <20%. This feature allows the user to easily identify when a new liquid cartridge is needed. Once the user reaches −10% the collar flashes red and a new liquid cartridge must be inserted.

Microphone from a Technical Aspect:

Analog Devices—ADMP404

The ADMP404 is a high quality, high performance, low power, and analog output bottom-ported omnidirectional MEMS microphone. The unit includes of a MEMS microphone element, an impedance converter, and an output amplifier. The sensitivity specifications make it an excellent choice for near field applications. The unit has a high SNR and flat, wideband frequency response, plus its low current consumption enables long battery life for portable applications. The ADMP404 is halide free. One configuration is in Table 10 below:

| Parameter | Symbol | Test Conditions/Comments | Min | Typ | Max | Unit |
|---|---|---|---|---|---|---|
| PERFORMANCE | | | | | | |
| Directionality | | | | Omni | | |
| Sensitivity | | 1 kHz, 94 db SPL | −41 | −38 | −35 | dBV |
| Signal-to-Noise Ratio | SNR | | | 62 | | dBA |
| Equivalent Input Noise | EIN | | | 32 | | dBA SPL |
| Dynamic Range | | Derived from EIN and maximum acoustic input | | 88 | | dB |
| Frequency Response | | Low frequency −3 dB point | | 100 | | Hz |
| | | High frequency −3 dB point | | 15 | | kHz |
| | | Deviation limits from flat response within pass band | | −3/+2 | | dB |
| Total Harmonic Distortion | THD | 105 dB SPL | | | 3 | % |
| Power Supply Rejection | PSR | 217 Hz, 100 mVp-p square wave superimposed on VDD = 1.8 V | | 70 | | dB |
| Maximum Acoustic Input | | Peak | | 120 | | dB SPL |
| POWER SUPPLY | | | | | | |
| Supply Voltage | VDD | | | 1.5 | | V |
| | | | | 3.3 | | |
| Supply Current | IS | | | 250 | | μA |
| OUTPUT CHARACTERISTICS | | | | | | |
| Output Impedance | ZOUT | | | 200 | | Ω |
| Output DC Offset | | | | 0.8 | | V |
| Output Current Limit | | | | 90 | | μA |

NVRAM:

The proposed Liquid Cartridge 270 will have a four pin, SPI interface, Non-Volatile Random Access Memory (NVRAM), 262, chip embedded into it or can have any other authentication as discussed herein. The liquid cartridge will have one electrical contact, 266, on it, held on by clip, 264, which will supply power and data lines from the authentication to the PCB. The authentication will contain an identifying serial number for use in quality control, easily allowing the manufacturer to identify product lots in the case of a needed product recall or other customer care issue.

The authentication will contain the data as to the current fluid level remaining in the fluid cartridge. This serves four purposes:

1. Provide information to the consumer of the fluid level remaining.

2. Inhibit the user from refilling the cartridge. Once the NVRAM shows the fluid cartridge to be 110% empty the heater will no longer activate until a new fluid cartridge is inserted.
3. Prevent the user from overheating and damaging the heater when no liquid present.
4. Allow the user to transfer one fluid cartridge to multiple battery and heater assemblies without losing the status of the fluid level.

Concerning purpose 4 (above), one embodiment provides for a configuration to store all liquid level information on the PCB in the battery assembly. The Microcontroller would be informed of a new liquid cartridge being inserted via a simple switch in the heater assembly that became depressed once a cartridge was inserted.

1. Should the current liquid cartridge be removed and re-inserted, the unit would assume a new, full, cartridge had been inserted when this may not be the correct state.
2. Should the battery become depleted and the user switched battery assemblies, the new battery assembly would assume a new, full cartridge was in place.

By placing the authentication on the fluid cartridge itself, and storing the liquid level state on it, we bypass the above issues. Each time a puff is taken the microcontroller on the battery PCB makes a call to the authentication to update its usage and reads the previous state. This previous state information is then transmitted back to the battery assembly PCB and a determination is made at to the total liquid level remaining, activating the Liquid Cartridge Level LED.

Figure 23:
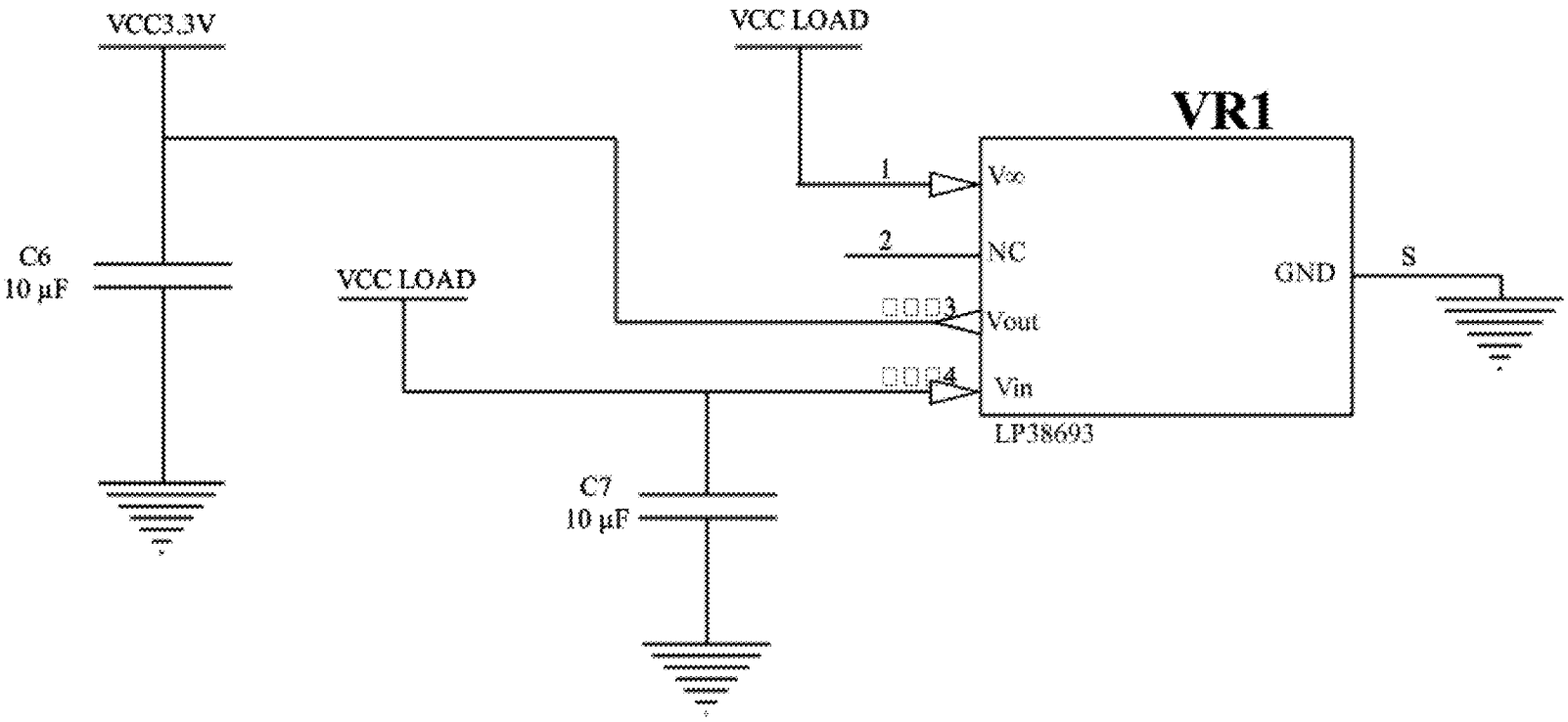
FIG. 23 demonstrates one configuration of the present invention.

The NVRAM in one embodiment is preferred due to its low price point and durability. Technical information is as follows and shown in FIG. 23:

Memory Size: 8 Kbit
Organization: 1K×8
Data Retention: 100 years
Maximum Clock Frequency: 5 MHz
Maximum Operating Current: 5 mA
Operating Supply Voltage: 3.3V
Maximum Operating Temp: +85 C
Package: UDFN
Access Time: 75 ns
Minimum Operating Temp: −40 C
Interface: SPI Digital Potentiometer:

The new unit utilizes one digital potentiometer to allow the user 5 "heater intensity" settings. These settings range from 2.8V to 3.5V. The user can select the settings via GUI, FIG. 5.

Manufacturers, regardless of product, will activate heaters with a variable pulse width modulation scheme (PWM) which creates confusion in what voltage is actually being applied to the heater. In this configuration is an adjustable regulator that will output a constant DC voltage based on a digital potentiometer. This method is extremely accurate.

LiPo Battery:

The present invention is configured with a custom "e" shaped 3.7v 850 mAh LiPo rechargeable battery, 212, will be wrapped around the rigid PCB in the battery cartridge. LiPo was chosen due to its high-energy capacity and low self-discharge rate, as well as its ability to be custom shaped to the applications needs. LiPo also presents a safer alternative to Li-ion batteries in that they do not create as much heat or swelling during discharge. In addition a LiPo will not typically explode during a catastrophic failure of the casing. The "e" shape is necessary to maximize the capacity of the battery relative to the space allowed. Being that the PCB sits uneven in the battery cartridge the battery itself has to be larger on one side and smaller on the other, or a shape similar to the letter "e". The battery will have two rigid connections to the PCB decreasing the failure potential presently seen in light wire gauges. By increasing the battery capacity to 850 mAh the user will enjoy a large increase in time between charging.

Accordingly the present invention encompasses the following calculations for the benefit battery optimization and should provide:

Battery of 850 mAh converted to seconds is 3,060,000 of 1 mA current.

The current range is 400-800 mA and the present invention has found that vapor is produced over the entire range. In one embodiment, the heater can go up to 1.2 A.

In one embodiment, 50 mA powers the LED's. However, the present invention encompasses range of about 5 mA up to as high as 150 mA. In one embodiment, 40 mA powers the pressure sensor/micro and support circuitry. However, the present invention encompasses range of about 5 mA up to as high as 116 mA.

Assume a 30 second cycle between puffs is a full run cycle; a shorter cycle will only give us more available puffs.

800 mA/s for the heater.

50 mA for the LED's (this is double our realistic amount)

40 mA for pressure sensor/micro and support circuitry

So for three seconds we consume 890 mA×3=2670 mA and the remaining 27 seconds were in "low power mode" consuming only 5 mA (double our real calculation).

So for 30 seconds we consume 2670+135=2,805 mA seconds of our total 3,060,000.

That means we have 3,060,000/2,805=1,091 30 second periods for a total time of 1091/2 (2 per minute)=546 minutes or 9.09 hours before the battery dies.

The previous battery provided for 200-300 puffs, the present invention should allow for 1,091 puffs, a drastic increase.

A fuel gauge will also be implemented onto the PCB to provide the user a read out of their current charge level via a LED (see Ash Tip LED) on the ash tip, which can be checked at any time by pressing and holding the ash tip push button for 1 second. When battery is depleted the ash tip will flash red indicating a charge is needed. The fuel Gauge will also provide information to the GUI (graphical user interface) when connected to a computer and provide additional information such as the number of charges to date, the amperage and voltage, and diagnostics.

Battery Technical Information:

Nominal Capacity: 850 mAh
Nominal Voltage: 3.7V
Charge Current: 1 C5 A
Charge Cut-off Voltage: 4.20+−0.03V
Standard Discharge Current: 0.2 C5 A
Max Discharge Current: 2.005 A
Discharge Cut-Off Voltage: 2.75V
Impedance: <=300 mOhm
Weight: 10 g
Storage Temp: −20-+45 C
Storage Humidity: 65+/−20% RH A SMT LED RGB (red, blue, green), 240, will be placed on the PCB near the ash tip, and will glow when the user is inhaling to simulate burning ash on a traditional cigarette. A pushbutton, 234, on the battery end, ash tip, will allow the user to select between six colors via color mixing as well as turning the LED completely off by a quick depress of the button. The seven modes will cycle upon pushing the button, e.g. ash tip is red, seven pushes of the button to be at the back a red ash tip. By allowing the user to change the ash tip color to another color, or off, helps reduce the similarity to a real cigarette thereby avoiding confusion in public.

The ash tip LED will also serve as a battery fuel indicator. Receiving its information from the Fuel Gauge located on the PCB, the LED will provide readout of the current battery charge. When the user depresses the pushbutton for one (1) second the LED will illuminate red, yellow, or green to alert the user to the state of charge. The user will automatically be informed with each state change after a puff. As an example, should the state change from green to yellow, the user will be automatically informed via the ash tip glowing yellow for one second after a puff is taken. The ash tip will also flash red once the battery is fully discharged.

Speaker:

A small piezoelectric speaker, 238, similar to those used in inner-ear hearing aids was to be placed on the PCB in the battery cartridge. The speaker would provide status tones for fluid and battery level as well as simulate the crackling sound of a traditional cigarette.

Figure 24:
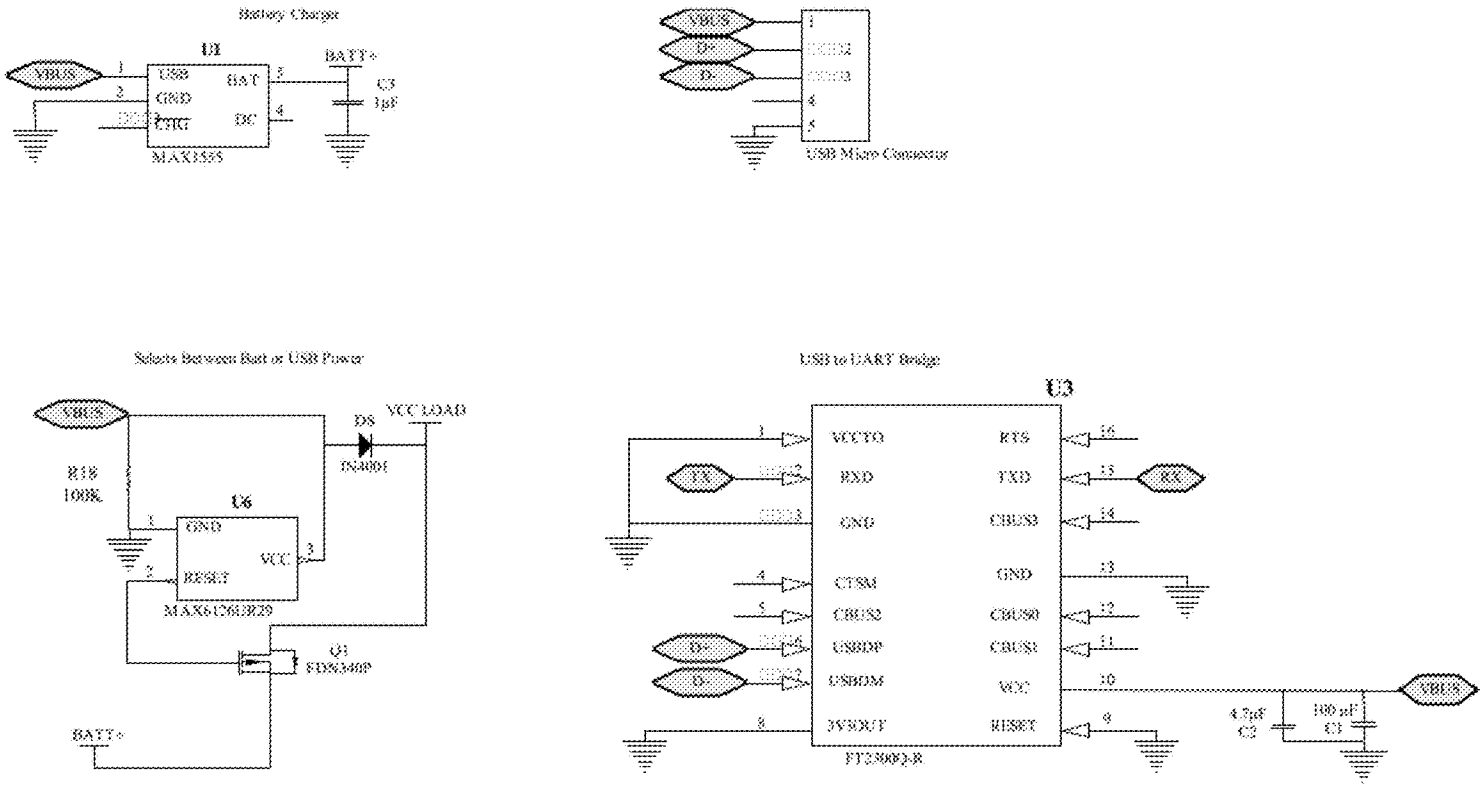
FIG. 24 demonstrates one configuration of the present invention.

Micro-USB Type B:

The present invention provides a new dongle for charging and also has a micro-USB type B female adapter, 232, at the ash tip end for attaching to either a user's computer or adapters and at the opposite another dongle has a micro USB connection. This is a simple push pull connection very typical of a user's average cell phone connection. No chance of over twisting or destroying the battery. When users plug in the new dongle micro USB adapter and improved battery configuration and circuit configuration, the present invention provides it will take between 15 min. and 40 min. to charge the new battery as well as the user is still able to use the device while charging. The micro-USB serves to charge the device as well as interact with the GUI to control features of the device. One configuration is shown in FIG. 24:

GUI (Graphical User Interface):

As shown in FIG. 5, a GUI has been developed to allow the user to control certain features and monitor certain states of their product. The GUI will initially be available for access on both MAC and PC, with the GUI being stored internally to the device. A further option available to the consumer, once connected to a computer, will be activation via the Internet allowing for additional features and registration of the device. The main features included are as follows:

1. Graphical display of remaining battery life
2. Graphical display of remaining fluid in each fluid cartridge
3. Counter of total puffs taken
4. Ability to change the "variable voltage" setting of each heater.
5. Ability to run diagnostics on the device to ensure proper function and for troubleshooting by customer service
6. Integration to a consumer website
7. "Send to Device" button for uploading changes to the device.
8. Ability to connect to a server for GUI and product updates New Heater Configuration:

The new heater configuration, 256 & 252, utilizes 800 mA at every activation, and uses a 3.7 V 800 mA hour battery and is creating a vapor of approximately 3.75 L at each activation. This is a 24% less power usage than the old configuration and a 100% increase in vapor output. In one embodiment, the new heater performance in 3 seconds is 375° F. and in 5 seconds reaches 390° F. In another embodiment, the new heater performance in 3 seconds is 250-375° F. an in 5 seconds reaches 300-500° F.

This is due to the new heater configuration that optimizes resistance versus surface area of heater that makes contact with the e liquid. Our new heater configuration is a custom configuration that does not exist in the marketplace right now. The present invention is utilizing a ceramic or nylon substrate and attaching Nichrome raceways almost in the same manner as laying up a circuit board. The manufacturing process used to make this heater is a new configuration. One of the advantages of our new heater configuration is the optimization of the surface area of the metal tracings that actually make contact with the E liquid which is wicked on to a fiberglass round disc Pad. By creating more surface area of the metal tracings making contact with the actual E liquid the present invention produces more vapor. The old configuration heater utilizing 0.004 in diameter Nichrome wire wrapped around a wick only makes contact with the E liquid by approximately ½ the diameter of the Nichrome wire. This configuration minimizes the wire contact with the liquid thus producing less vapor during each activation. Another advantage of this new heater configuration is a controlled manufacturing process, which produces repeatable results every time a unit is manufactured. The present invention also eliminates the human error factor in the old production method used in the old heater assembly where a line of 16 Chinese women are standing in line wrapping wire around a wick and soldering the wires together all in a hand assembly. The old method allows for the human error factor. The new method of manufacture for the heater assembly is a controlled manufacturing process that does not allow for the human error factor. This creates a better quality controlled manufactured product. The complete heater pad assembly includes a ceramic circuit board heater subassembly, a scavenging pad which works as a wick for the E liquid, five electronic pins for electronic transmission to electronic components, and an insulation ring which holds the scavenging pad up against the raceways on a ceramic perforated disc. The insulation ring holds all the components together and also creates insulation between the heat of the tracings and the outer diameter of the electronic cigarette housing to minimize heat felt by the consumer at the touch of their fingers. Another advantage of this new heater configuration is the capability of assembling all components in an automated assembly sequence. This automated assembly will also eliminate human error and increase the quality of the end product. The new heater assembly configuration is a machine-manufactured configuration. Since the electronic circuit board driving the new heater is included in developing a software application that will enable control via the GUI software to adjust the heater to a preferred volume of vapor output. It is contemplated that the amperage allowed to enter the heating element will control this.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

We claim:

1. An electronic cigarette system comprising:

a main body having an inner cavity;

electronic circuitry, including a main circuit board and battery, wherein said circuitry is housed in said cavity;

a fuel gauge operatively associated with said electronic circuitry, said gauge configured to provide a user information relating to at least one of current charge level, a number of charges to date, amperage/voltage, system diagnostics, or combinations thereof;

a delivery chamber containing at least one delivery solution, housed in said cavity; an actuator, being a capacitive touch actuator constructed and arranged to only function based on absolute capacitance when lips come in contact with said actuator, wherein said actuator is configured to interact with said system; a heater cartridge operatively associated and separate from said delivery chamber and said actuator;

at least one air flow inlet formed in said body;

at least one air flow outlet, wherein said inlet and outlet define a channel for an airflow path, and wherein said airflow path is configured such that air flow has no contact with said circuitry;

wherein said electronic cigarette is constructed and arranged to heat a delivery material contained in said chamber, said material is formed into a gas and exits said electronic cigarette through said outlet.

2. The electronic cigarette of claim 1 wherein said delivery chamber houses at least one vaporizable material.

3. The electronic cigarette of claim 1 wherein said delivery chamber houses a vaporizable material that is a solid, liquid, gas, or combinations thereof.

4. The electronic cigarette of claim 1 wherein said delivery chamber houses a composition containing nicotine.

5. The electronic cigarette of claim 1 wherein said delivery chamber houses a liquid which is vaporized by said heater.

6. The electronic cigarette of claim 1 wherein said airflow inlet is formed on an anode collar formed on said elongated body.

7. The electronic cigarette of claim 1 wherein said heater is rated 1000-1400 mA, is formed of nylon and Nichrome, and heats from 20°-375° F. in about 2 seconds.

8. The electronic cigarette of claim 1 wherein said delivery chamber is a cartridge having associated therewith an encrypted identification system having operatively associated therewith constructed and arranged to interact with at least one electronic structure for authenticating said cartridge by said cigarette.

9. The electronic cigarette of claim 1 wherein said battery is a rechargeable battery.

10. The electronic cigarette of claim 1 further comprising a speaker operatively associated with said circuitry and configured for generating audible status tones for at least one of battery charge, delivery chamber volume, overall system operation, or combinations thereof.

11. The electronic cigarette of claim 1 wherein said circuitry is constructed and arranged to connect with a graphical user interface.

12. The electronic cigarette of claim 1 wherein said circuitry is constructed and arranged to connect with a graphical user interface thorough a wired or wireless connection.

13. The electronic cigarette of claim 1 wherein said heater is operatively associated with a potentiometer.

14. The electronic cigarette of claim 1 having at least one airflow sensor operatively associated with air entering through said inlet and exiting through said outlet.

15. The electronic cigarette of claim 1 further having a microphone operatively associated with said electronic cigarette activation and use said microphone being tuned to a specific frequency created when a user puffs on the device, drawing air into said electronic cigarette, and creating a sound based on a configuration of the inlet holes, said microphone will not activate based on any other sound, thereby removing the possibility of a false activation, said microphone configured to obtain the duration of a puff, and accurately predict the amount of liquid used in said puff.

* * * * *